US006517984B1

(12) United States Patent
Ferrar et al.

(10) Patent No.: US 6,517,984 B1
(45) Date of Patent: Feb. 11, 2003

(54) SILSESQUIOXANE COMPOSITIONS CONTAINING TERTIARY ARYLAMINES FOR HOLE TRANSPORT

(75) Inventors: Wayne Thomas Ferrar, Fairport, NY (US); Jane Robinson Cowdery-Corvan, Webster, NY (US); William Tod Gruenbaum, Rochester, NY (US); Jeanne Ellen Kaeding, Rochester, NY (US); Michel Frantz Molaire, Rochester, NY (US); Louis Joseph Sorriero, Rochester, NY (US); David Steven Weiss, Rochester, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/818,956

(22) Filed: Mar. 27, 2001

(51) Int. Cl.[7] ..... G03G 5/047; G03G 5/147
(52) U.S. Cl. ..... 430/58.2; 430/66; 430/67
(58) Field of Search ..... 430/58.2, 66, 67

(56) References Cited

U.S. PATENT DOCUMENTS

| | | | | |
|---|---|---|---|---|
| 4,439,509 | A | | 3/1984 | Schank |
| 4,609,486 | A | | 9/1986 | Freiberg et al. |
| 4,753,827 | A | | 6/1988 | Yoldas et al. |
| 4,754,012 | A | | 6/1988 | Yoldas et al. |
| 4,917,980 | A | | 4/1990 | Badesha et al. |
| 4,923,775 | A | | 5/1990 | Schank |
| 5,116,703 | A | | 5/1992 | Badesha et al. |
| 5,145,907 | A | | 9/1992 | Kalinowski et al. |
| 5,688,961 | A | | 11/1997 | Kushibiki et al. |
| 5,693,442 | A | | 12/1997 | Weiss et al. |
| 5,712,360 | A | | 1/1998 | Kobayshi et al. |
| 5,731,117 | A | | 3/1998 | Ferrar et al. |
| 5,824,443 | A | | 10/1998 | Kushibiki et al. |
| 5,840,816 | A | | 11/1998 | Kobayshi et al. |
| 5,888,690 | A | | 3/1999 | Yoshinaga et al. |
| 5,905,008 | A | | 5/1999 | Yoshinaga et al. |
| 5,910,272 | A | | 6/1999 | Kushibiki et al. |
| 6,030,736 | A | | 2/2000 | Ikegami et al. |
| 6,046,348 | A | | 4/2000 | Yamada et al. |
| 6,143,452 | A | | 11/2000 | Sakimura et al. |
| 6,187,491 | B1 | * | 2/2001 | Ferrar et al. ..... 430/58.2 |
| 6,203,962 | B1 | | 3/2001 | Itami et al. |
| 6,265,122 | B1 | | 7/2001 | Itami et al. |
| 2001/0019674 | A1 | * | 9/2001 | Asano et al. ..... 430/58.2 |

* cited by examiner

*Primary Examiner*—Christopher Rodee

(57) ABSTRACT

An electrophotographic element comprises: an electrically conducting layer, a charge generating layer overlying the electrically conducting layer, and a charge transport layer overlying the electrically conducting layer. The charge transport layer, which can be an overcoat overlying the charge generating layer, comprises the reaction product in an aqueous medium of a mixture comprising a silsesquioxane polymer and a hole transport compound that comprises a tertiary arylamine containing at least one alcoholic or one phenolic hydroxy substituent.

27 Claims, No Drawings

SILSESQUIOXANE COMPOSITIONS CONTAINING TERTIARY ARYLAMINES FOR HOLE TRANSPORT

FIELD OF THE INVENTION

The present invention is related to electrophotography and, more particularly, to photoreceptors having silsesquioxane overcoats that contain hydroxysubstituted hole transport agents.

BACKGROUND OF THE INVENTION

In charge generating elements, incident light induces a charge separation across various layers of a multiple layer device. In an electrophotographic charge generating element, also referred to herein as an electrophotographic element, an electron-hole pair produced within a charge generating layer separate and move in opposite directions to develop a charge between an electrically conductive layer and an opposite surface of the element. The charge forms a pattern of electrostatic potential, also referred to as an electrostatic latent image. The electrostatic latent image can be formed by a variety of means, for example, by imagewise radiation-induced discharge of a uniform potential previously formed on the surface. Typically, the electrostatic latent image is developed by contacting it with an electrographic developer to form a toner image, which is then fused to a receiver. If desired, the latent image can be transferred to another surface before development, or the toner image can be transferred before fusing.

The requirements of the process of generating and separating charge place severe limitations on the characteristics of the layers in which charge is generated and holes and/or electrons are transported. For example, many such layers are very soft and subject to abrasion. This places severe constraints on the design of charge generating elements. Some configurations cannot provide a reasonable length of service unless an abrasion resistant overcoat layer is provided over the other layers of the element. This presents its own problems, since charge must be able to pass through the overcoat.

The resistivity of an overcoat has major consequences in an electrophotographic system. If the overcoat has high resistivity, the time constant for voltage decay will be excessively long relative to the processing time for the electophotographic element, and the overcoat will retain a residual potential after photodischarge of the underlying photoreceptor. The magnitude of the residual potential depends upon the initial potential, the dielectric constants of the various layers, the thickness and the charge transport characteristics of each layer. A solution has been to reduce the thickness of the overcoat layer. Another solution is to provide an overcoat that is conductive. The overcoat must, however, not be too conductive. The electrophotographic element must be sufficiently electrically insulating in the dark that the element neither discharges excessively nor allows an excessive migration of charge along the surface of the element. An excessive discharge ("dark decay") would prevent the formation and development of the latent electrostatic latent image. Excessive migration causes a loss of resolution of the electrostatic image and the subsequent developed image. This loss of resolution is referred to as "lateral image spread." The extent of image degradation will depend on the processing time for the electrophotographic element and the thicknesses and dielectric constants of the layers. It is thus desirable to provide an overcoat that is neither too insulating nor too conductive.

The triboelectric properties of the overcoat must be matched to the triboelectric characteristics of the electrophotographic toner used to develop the electrostatic latent image. If the triboelectric properties are not matched, the electrophotographic element will triboelectrically charge against the electrophotographic toner. This causes disruption of the charge pattern of the electrostatic latent image and results in background in the resulting toner image. For example, an overcoat can triboelectrically match a particular negatively charging toner, but not triboelectrically match another toner that charges positively.

In an electrophotographic process, an organic photoreceptor is subjected to a variety of physical and chemical abuses that may limit its productive lifetime. As already noted, the surface of an organic photoreceptor is relatively soft, so that cleaning, by blade or brush, causes scratches and abrasive wear. Unintended contacts of the surface with sharp objects may result in scratches that necessitate immediate photoreceptor replacement. The photoreceptor surface is also relatively permeable and its components are reactive towards the ozone and nitrogen oxides generated during corona charging. After extended exposure to such chemicals, the electrophotographic characteristics may degrade to the point where image defects become objectionable and the photoreceptor must be replaced. Organic photoreceptors are also susceptible to photochemical damage from ultraviolet radiation emitted from the corona discharge or from exposure to room light. As a result of these factors, the lifetime limit of an organic photoreceptor is on the order of one hundred thousand cycles. By contrast, a lifetime of one million cycles is typical of the much harder amorphous selenium and arsenic triselenide photoreceptors. Extensive efforts have therefore been made to protect organic photoreceptors from physical, chemical, and radiation damage, as disclosed, for example, in U.S. Pat. Nos. 5,204,201; 4,912,000; 4,606,934; 4,595,602; 4,439,509; and 4,407,920. The protection of organic photoconductors using an overcoat comprising various polysiloxane mixtures in a polycarbonate resin is described in U.S. Pat. No. 6,030,736.

Silsesquioxanes are a class of silicone polymers that are useful as abrasion resistant overcoats, including overcoats for organic photoreceptors. Overcoating an organic photoreceptor with a silsesquioxane layer can provide protection from physical, chemical, and radiation damage. Silsesquioxane layers are harder than organic photoreceptors and less permeable to chemical contaminants. Silsesquioxanes can be imbibed with acid scavengers to keep contaminants, such as acids, from reaching the photoreceptor surface. Also, dyes can be added to silsesquioxane layers to protect the photoreceptor from photofatigue, especially from room lights.

A silsesquioxane layer would also be expected to increase the efficiency of particle transfer from the photoreceptor surface. The surface energies of silsesquioxane layers are lower than those of organic polymers and, in addition, are typically smooth and hard, as measured by the higher moduli than those of polyesters and polycarbonates. These factors combine to make silsesquioxanes good release coatings, which should aid in toner transfer, an increasingly significant consideration as toner particle size decreases to meet the demands of higher image resolution. Silsesquioxane overcoats for organic photoreceptors are disclosed in, for example, U.S. Pat. Nos. 5,731,117; 5,693,442; 5,874,018; and 6,066,425.

Charge transport materials (CTMs) are generally added to polymeric layers to transport charge in organic photoreceptors. These layers are generally insulators that carry charge when either holes or electrons are injected into them. U.S.

Pat. No. 3,542,544 discloses triphenylmethanes and tetraphenylmethanes substituted with dialkylamines as CTMs that are incorporated into photoconductive elements. Triphenylmethane CTMs containing hydroxyaniline groups to facilitate incorporation into polymer structures such as polyamide film-forming overcoats arylamines are described in U.S. Pat. No. 5,368,967. Electrophotographic photoreceptors in which triarylamine compounds with dihydroxy substituents are covalently bonded into polycarbonate resins are disclosed in U.S. Pat. No. 5,747,204. The incorporation of triarylamines in a functional subunit of a composition that also includes an inorganic glassy network subunit and a flexible organic subunit is discussed in U.S. Pat. No. 5,116,703. Imaging members containing hole transporting polysilylene ceramers are described in U.S. Pat. No. 4,917,980.

The incorporation of tertiary arylamines into silsesquioxane polymers for the purpose of transporting holes has been detailed in a series of patents: U.S. Pat. Nos. 5,688,961; 5,712,360; 5,824,443; 5,840,816; and 5,888,690. These patents employ a silane that has been covalently bonded to a phenyl ring of a tertiary amine through a non-hydrolyzable Si—C bond. Other synthetic pathways used to prepare triarylamines that have trialkoxysilane moieties attached through a Si—C bond are described in U.S. Pat. No. 6,046,348. The resulting trialkoxysilyl-substituted triarylamines are coated as a protective overcoats containing a commercially available silicone hard coat material.

Recent articles in the chemical literature have compared sol-gel networks, including silsesquioxanes, that have useful moieties such as organic dyes attached to the siloxane network through non-hydrolyzable Si—C bonds and the equilibrium control addition through Si—O—C. For example, higher quantities of perylenes can be incorporated into sol-gel networks by first coupling the dye to the silane and then forming the network, as described in M. Schneider and K. Mullen, *Chem. Mater.,* 2000, Vol. 12, p 352.) Alternatively, a dye can be incorporated in the sol-gel formation process, as described in C. Sanchez and F. Ribot, *New J. Chem.,* 1994, Vol. 18, p 1007.; C. Sanchez, F. Ribot, B. Debeau, J. Mater. Chem. 1999, 9, 35.; F. Ribot and C. Sanchez, *Comments on Inorganic Chemistry,* 1999, Vol. 20, p 327; and T. Suratwala et al., *Chem. Mater.,* 1998, Vol. 10 pp 190, 199.

The disclosures of all the patents and other publications cited in the Background of the Invention are incorporated herein by reference.

SUMMARY OF THE INVENTION

The present invention is directed to an electrophotographic element that comprises: an electrically conducting layer, a charge generating layer overlying the electrically conducting layer, and a charge transport layer overlying the electrically conducting layer. The charge transport layer, which can be an overcoat overlying the charge generating layer, comprises the reaction product in an aqueous medium of a mixture comprising a silsesquioxane polymer and a hole transport compound that comprises a tertiary arylamine containing at least one alcoholic or one phenolic hydroxy substituent.

DETAILED DESCRIPTION OF THE INVENTION

The present invention relates to new abrasion resistant layers incorporating hydroxysubstituted hole transport agents that are compatible with silsesquioxanes . The new layers, which show good photodischarge when used as overcoats on top of standard charge transport layers containing triarylamine transport agents, can also be used in their own right as charge transport layers in place of the standard layers. The new layers also have the advantage of not being humidity sensitive because they are insulators that are able to transport holes. Thus, unlike prior art ion-conducting silsesquioxane layers, they do not suffer from image degradation resulting from lateral image spread at high humidity. The overcoats, which preferably have a thickness of about 0.5 to 10 microns, more preferably, about 1 to 3 microns, can be coated from a variety of aqueous solvents.

The silsesquioxane polymer employed in the present invention are the products of the hydrolysis and condensation of at least one alkyltrialkoxysilane having the structure $$R^1—Si—(OR)_3$$

wherein R is an alkyl group containing 1 to about 4 carbon atoms, and $R^1$ is an aliphatic, cycloaliphatic, or aromatic group containing 1 to about 12 carbon atoms. Groups represented by $R^1$ can include substituent or connective moieties such as ethers, amides, esters, arylene, and the like. Preferably, however, $R^1$ is selected from the group consisting of alkyl or fluoroalkyl containing 1 to about 12 carbon atoms, cycloalkyl containing 5 to about 12 carbon atoms, and aryl containing 6 to about 12 carbon atoms. More preferable $R^1$ groups are alkyl groups containing 1 to about 3 carbon atoms, methyl being particularly preferred.

Silsesquioxanes, which are generally prepared by the hydrolysis and condensation of methyltrimethoxysilane (Scheme 1, R=—$CH_3$), are commercially available from various sources: for example, from Dow Corning as Vestar$^R$ Q9-6503, from General Electric as SHC$^R$ 1010, where SHC stands for Silicone Hard Coat, and, more recently, from Optical Technologies as Ultrashield$^R$, a hard coat that is specifically designed for photoreceptors.

Scheme 1

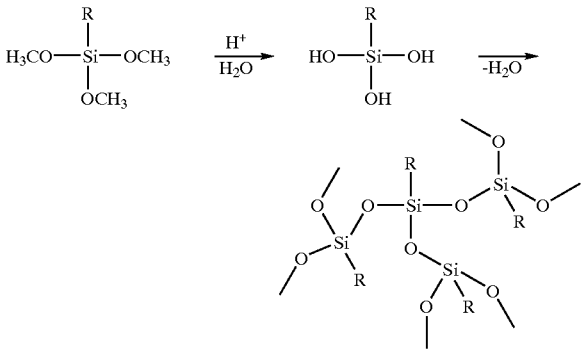

As disclosed in the above-mentioned U.S. Pat. Nos. 5,731,117 and 5,693,442, propyltrimethoxysilane has been introduced to make the sol-gel more organic in character, and glycidoxy ether substituted silane has been used to complex with lithium iodide for conductivity. A silsesquioxane produces a photoreceptor overcoat that is more resistant to corona, which is probably the result of an increase in hydrophobic character of the sol-gel due to an increase in the organic content.

In accordance with the present invention, a silsesquioxane-overcoated photoreceptor is rendered resistant to charge build up during cycling by the incorporation of a hole transport agent comprising a tertiary arylamine that contains at least one hydroxy functional group, thereby avoiding the lateral image spread that has been observed for the solid electrolyte silsesquioxane under conditions of high humidity. The hydroxy-functionalized tertiary arylamines, which are simply added to the alcoholic solution of sol-gel before coating in any desired amount up to about 30 weight percent, exhibit a variety of important advantages:

- are readily prepared by standard organic chemistry methods normally used to prepare CTMs for photoreceptors
- are not susceptible to unwanted hydrolysis and condensation as can take place with CTMs that have hydrolyzable trialkoxysilane moieties
- do not require the addition of unwanted catalysts that are used to prepare the covalently bonded CTMs
- do not require tin condensation catalyst to establish the linkage into the silsesquioxane network
- are soluble in the alcoholic solution of the sol-gel, giving a polar solution will not mar the surface of the photoreceptor film onto which it is deposited
- do not require coating from non-polar organic solvents, commonly used with CTMs having trialkoxysilane moieties, that attack the organic photoreceptor and cause mixing of the layers resulting from similar solubilities as covalently bonded to them before they are added to the silsesquioxane network Tertiary arylamine compounds useful as hole transport agents in accordance with the present invention can include 1 to 6 alcoholic and/or phenolic hydroxy substituents. Preferred compounds include triarylamines and N-hydroxyalkylsubstituted anilino compounds that contain 1 or 2 alcoholic substituents and are soluble in the aqueous solvent media used to apply the silsesquioxane overcoat.

Hole transport agents are generally based on aromatic amines where the molecule is oxidized to form a radical cation. As discussed above, aromatic amines have frequently been used in the preparation of organic photoreceptors. However they are generally soluble only in nonpolar organic solvents, dichloromethane or toluene, for example, and they are usually incompatible with the polar nature of the silsesquioxane polymers and the aqueous solvent systems employed with them. Organic solvents, including alcohols such as methanol, ethanol, and isopropanol are useful for the practice of this invention because of their compatibility with the water that is employed to hydrolyze the alkoxysilanes to form silsesquioxanes. In general, relatively small amounts, less than about 20 wt %, of water-miscible organic solvents can be added without adverse effect to the sol-gel solution. In general, it is preferred not to add water-immiscible solvents such as dichloromethane because they will partially dissolve or mar the layer on which the overcoat is to be formed. Methyl isobutyl ketone (MIBK), also known as 4-methyl-2-pentanone, is a useful solvent to aid in solubilizing the tertiary arylamine CTM compounds in the silsesquioxane reaction mixture.

The hydrolysis and condensation of the silanes are catalyzed by colloidal silica, silica particles that are stabilized by either an acidic or basic surface charge and exert a significant influence on the mechanical properties of the silsesquioxane coating. Preferably, up to about 20 weight percent of the colloidal silica, based on the amount of alkyltrialkoxysilane, is added to the mixture. More preferably, the amount of added silica is about 5 to about 10 weight percent, based on the silsesquioxane. A preferred colloidal silica, stabilized with a small amount of sodium oxide, is Ludox$^R$ LS, available from DuPont. When the volatile acetic acid, methanol and other solvents in the sol-gel are removed, the sodium oxide remains to act as a condensation catalyst for the formation of the silsesquioxane. The silsesquioxane network forms through Si—O—Si linkages, while the hydroxysubstituted CTMs would be expected to condense to form part of the siloxane network through Si—O—C linkages. Other bases such as hydroxides or acetates of alkali and alkaline earth metals are also appropriate catalysts for the hydrolysis and condensation in place of the colloidal silica. However, bases such as aminosilanes that interfere with hole transport through a polymer network doped with organic photoreceptor molecules would also be expected to interfere with hole transport through the silsesquioxane network and would therefore not be preferred in the practice of this invention.

In a typical procedure, ethyltrimethoxysilane is acidified with acetic acid and hydrolyzed with approximately 2.5 equivalents of water. The solution is then diluted with either ethanol or isopropanol, the LudoxR LS colloidal silica is added, and up to 40 wt % of an organic cosolvent such as methyl isobutyl ketone (MIBK) is added to help dissolve the hydroxysubstituted transport agent, which is then added at a desired level. The hydroxysubstituted CTMs are soluble in the solvents used to prepare the silsesquioxane, giving clear films when coated over photoreceptor at up to 30 weight percent loadings.

As noted above, tertiary arylamine hole transport compounds useful in the practice of the present invention, include 1 to about 6 alcoholic and/or phenolic hydroxy substituents. These compounds can be represented by the formula $$(A)_x—(LINK—OH)_y$$

wherein A is a tertiary arylamine moiety containing up to about 40 carbon atoms, LINK is an aliphatic or cycloaliphatic moiety containing 1 to about 10 carbon atoms, x is 1 or 2, and y is 1 to 6; or by the formula $$A—(OH)_y$$

wherein A is an arylene moiety containing up to about 40 carbon atoms and comprising at least one tertiary arylamine moiety, and y is 1 to 6. In compounds corresponding to the first of the foregoing formulas, LINK is preferably an aliphatic moiety, more preferably, an alkylene moiety. The aliphatic moiety comprising LINK can further include functional moieties such as, for example, amides and ethers.

Following are the structures of examples of tertiary arylamine hole transport compounds containing one or more alcoholic or phenolic hydroxyl groups, CTM IA-CTM XLVIIP, that are useful in the practice of the present invention:

CTM IA
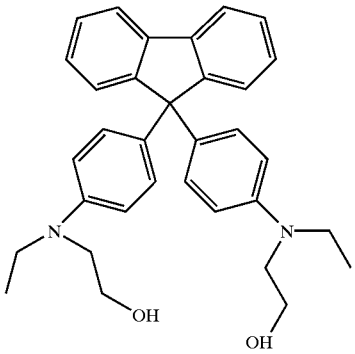
CTM IIA
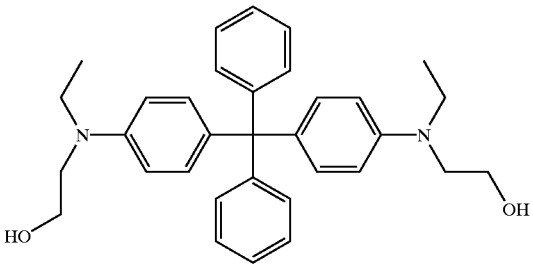
CTM IIIA
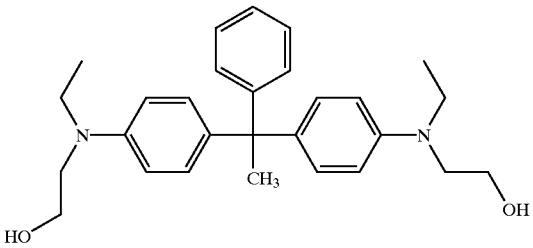
CTM IVP
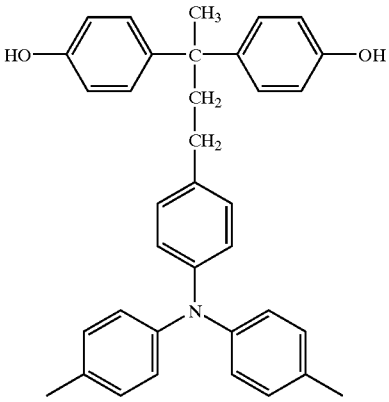
-continued
CTM VA
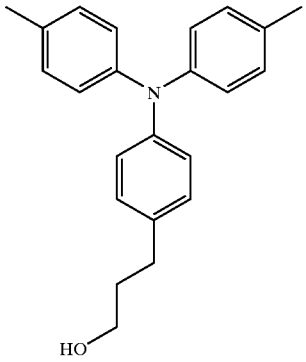
CTM VIA
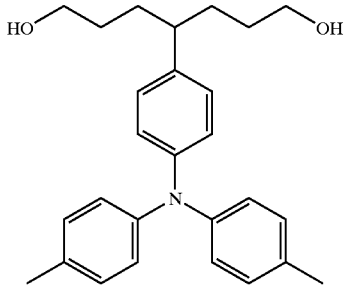
CTM VIIA
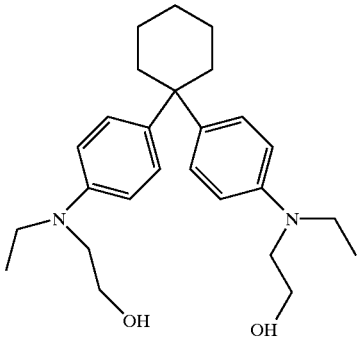
CTM VIIIA
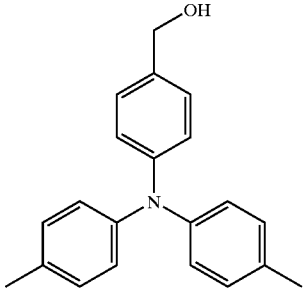
CTM IXA
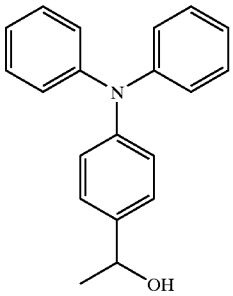

-continued
CTM XA
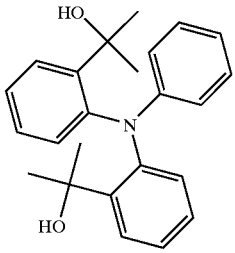
CTM XIA
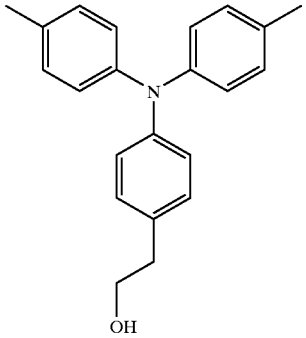
CTM XIIA
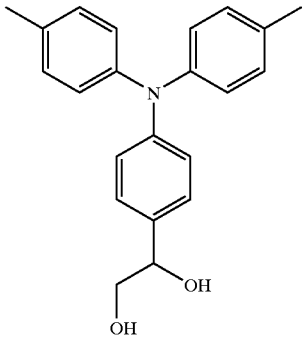
CTM XIIIA
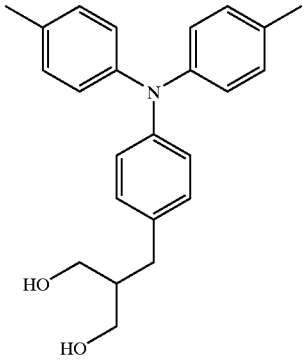
-continued
CTM XIVA
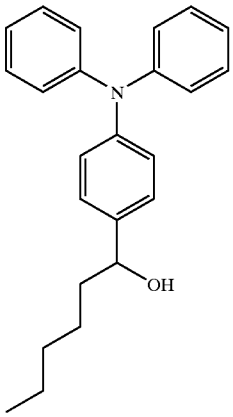
CTM XVA
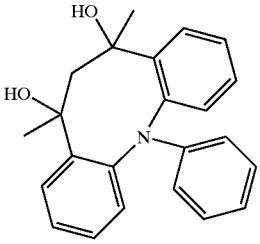
CTM XVIA
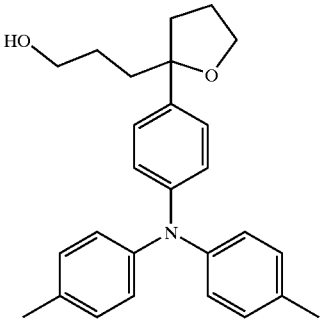
CTM XVIIA
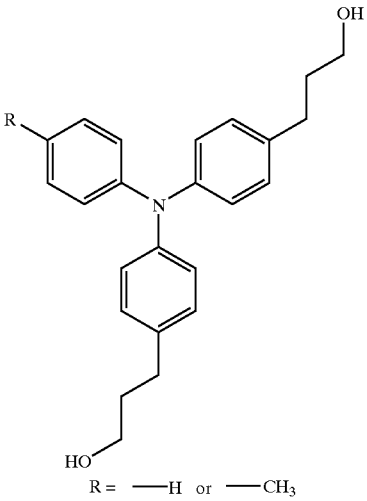

-continued
CTM XVIIIA
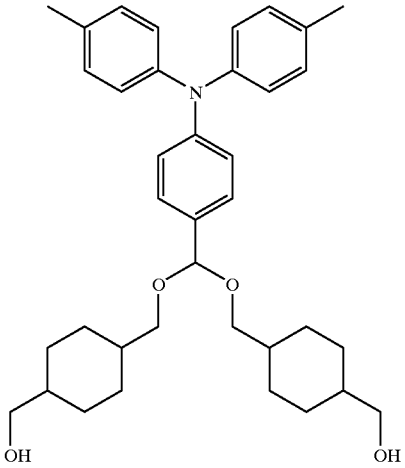
CTM XIXA
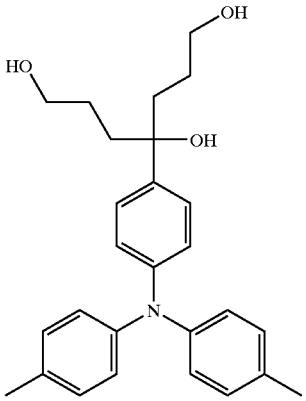
CTM XXA
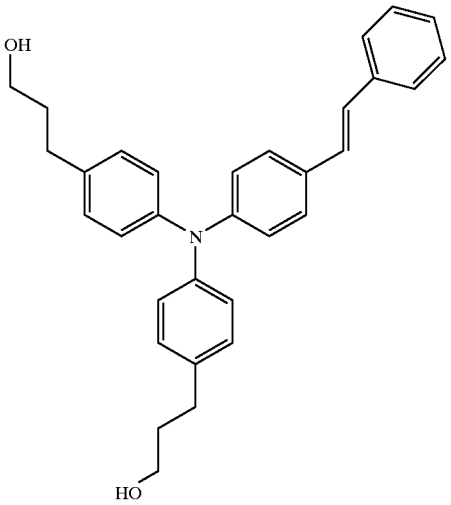
-continued
CTM XXIA
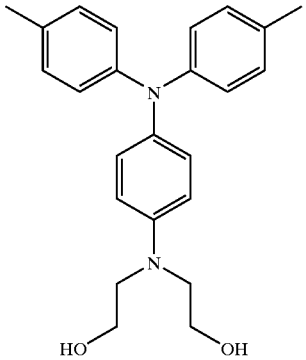
CTM XXIIA
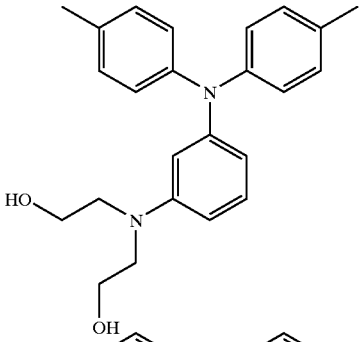
CTM XXIIIA
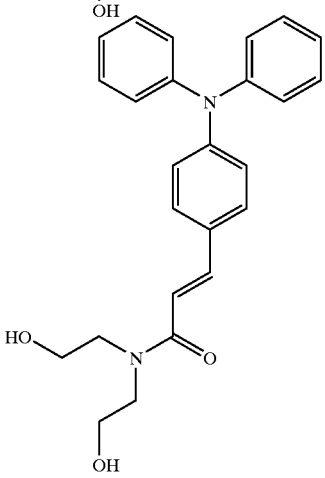
CTM XXIVA
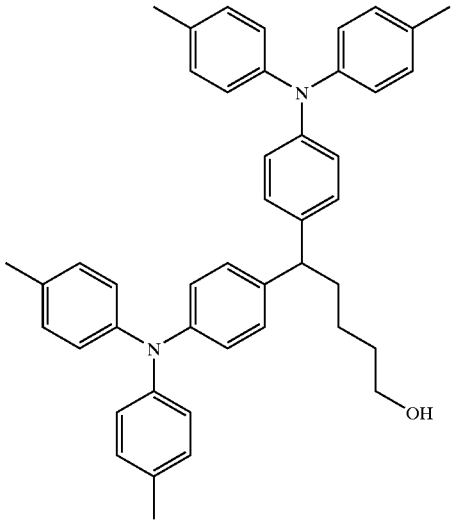

-continued
CTM XXVA
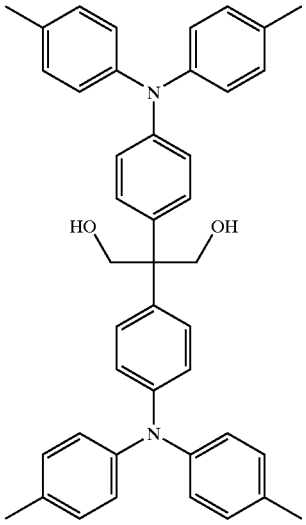
CTM XXVIA
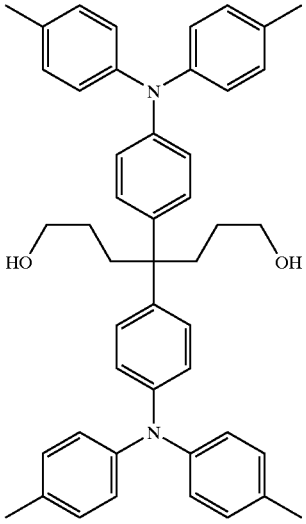
CTM XXVIIA
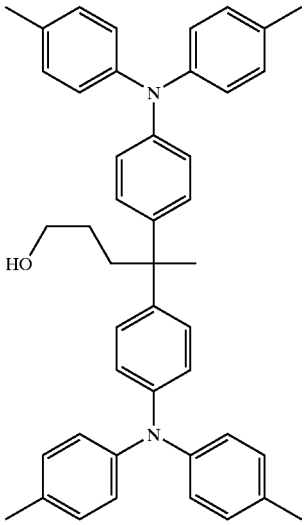
-continued
CTM XXVIIIA
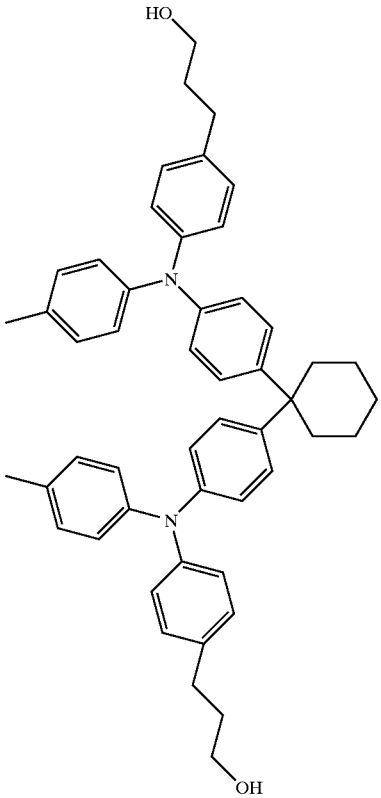
CTM XXIXA
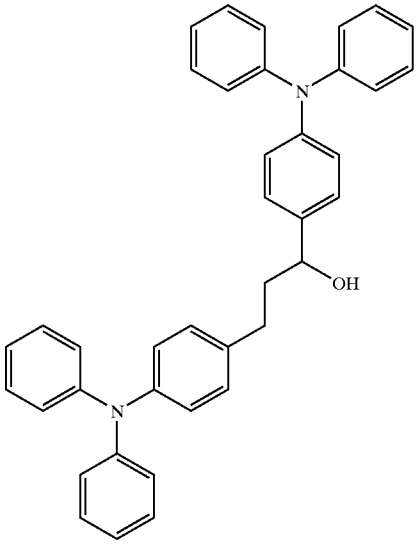

-continued
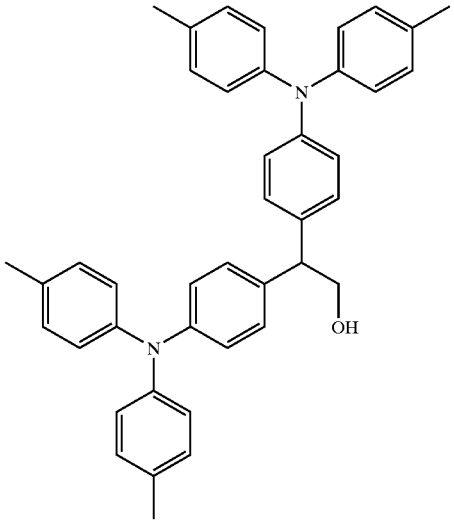
CTM XXXIA
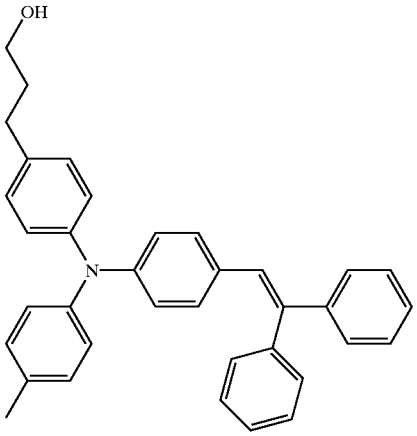
CTM XXXIIP
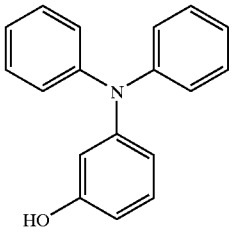
CTM XXXIIIP
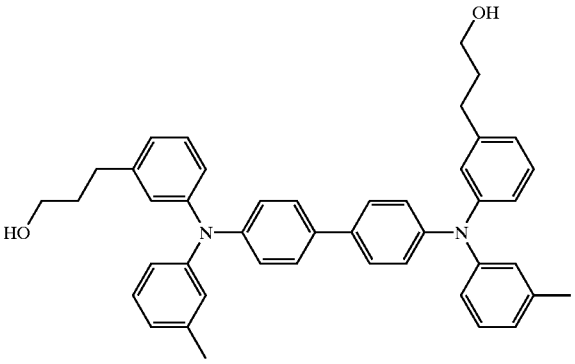
-continued
CTM XXXIVP
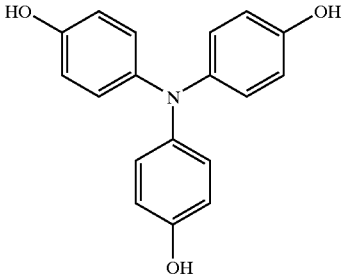
CTM XXXVP
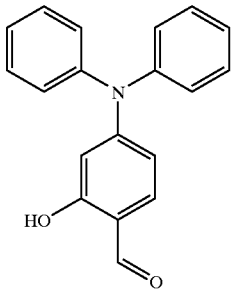
CTM XXXVIP
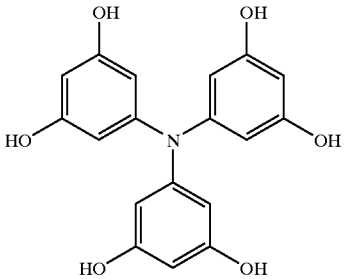
CTM XXXVIIP
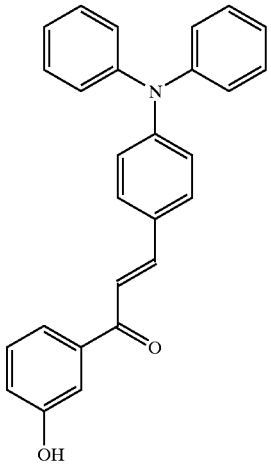
CTM XXXVIIIP
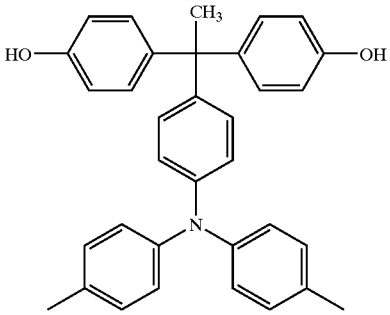

-continued

CTM XXXIXP

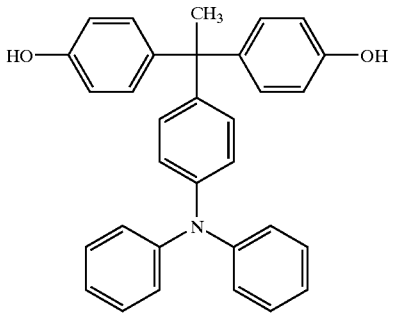

CTM XLP

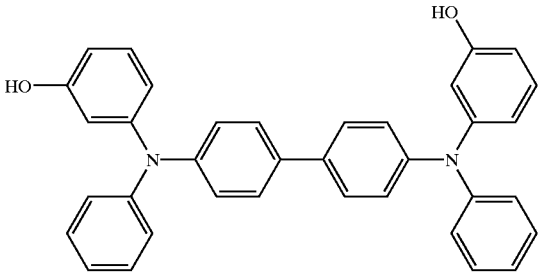

CTM XLIP

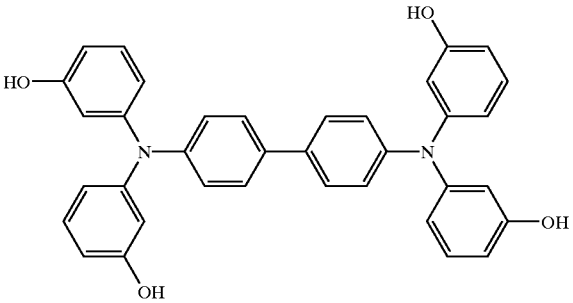

CTM XLIIP

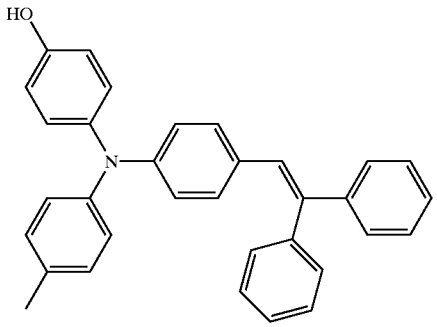

CTM XLIIIP

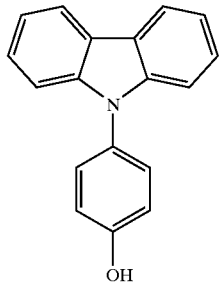

Tertiary amine hole transport compounds useful in the practice of the present invention include the following:

9,9-bis{4-[N-ethyl-N-(2-hydroxyethyl)]anilino}fluorene, CTM IA (structure shown above), a preferred example of the N-hydroxyalkylanilino-substituted tetraphenylmethane type of charge transfer materials, is a white crystalline solid having two N-(2-hydroxyethyl)-N-ethylanilino substituents off the central carbon atom of the fluorene moiety. The hydroxy groups allow incorporation of the aryl amine into the siloxane through Si—O—C bonds. In silsesquioxane overcoats of the present invention, the arylamine portion of the CTM IA structure serves to carry charge by hole transport. CTM IA may also act as an acid scavenger to protect the photoreceptor from acids such as nitrous oxides ($HNO_x$), which are by-products of the corona charging of the photoreceptor.

Other preferred organic tertiary arylamine photoconductors containing two N-hydroxyethyl substituents are CTMs IIA and IIIA (structures shown above).

Another type of amine transport agent that is effective for moving charge through the silsesquioxane is characterized by a triarylamine moiety pendent to the siloxane network, for example, the tritolylamine bisphenol A moiety in CTM IVP (structure shown above). The diol portion of this transport agent is thought to be incorporated into the silsesquioxane also through Si—O—C bonding, where the carbon is part of an aryl substituent. Generally, such bonds are not as stable as bonds formed where the carbon is from an alkyl group, as in the CTM IA-IIIA diols. However, triphenylamines generally have transport properties superior to other organic molecules, and should achieve some level of transport at lower levels.

CTM IVP should not act as an acid scavenger because the triarylamine moiety is less basic than the arylamine moiety of the anilino based CTMs IA-IIIA. Thus it may be beneficial to mix the two hole transport agents in such a proportion to achieve both charge transport and acid scavenger properties. Mixing the two transport agents may also improve the properties of the photoreceptor overcoat by inhibiting crystallization of the CTMs.

CTM VA (structure shown above) is a hydroxypropyl-substituted triarylamine whose single hydroxy group enables its incorporation into the silsesquioxane network. The resulting Si—O-propylene bond not only provides more stable incorporation than an Si—O-aryl bond, as discussed above for CTM IVP, but should be more stable than the benzylic bond obtained from a hydroxymethyl substituent on the triarylamine, e.g., CTM VIIIA.

CTM VIA (structure shown above), a tritolylamine with two hydroxypropyl substituents attached to one of the aryl substituent carbon atoms, has two sites for incorporation in the silsesquioxane network through the preferred Si—O-alkyl bond. As with the two other triarylamines, these compounds are preferred hole transport compounds but do not provide the acid scavenging properties of the aniline derivatives, CTMs I-IIIA.

Effective functioning of a transport agent in a silsesquioxane network requires incorporation of a sufficiently high level of the agent to achieve charge dissipation, preferably about 9 to about 30 weight percent, more preferably about 15 to about 25 weight percent, based on the alkyltrialkoxysilane.

The hydroxy moiety of the tertiary amine participates in a condensation reaction to form Si—O—C bonds with the silsesquioxane. The exchange of alkoxides in the sol-gel process is known to be an equilibrium reaction. Because the tertiary amine diols are not volatile, they limit the condensation of the silane network. The extent of siloxane formation was evaluated using solid state $^{29}Si$ nuclear magnetic resonance (NMR) spectroscopy. The spectrum of the methylsilsesquioxane, after it was removed from the support, showed only $T^2$ and $T^3$ resonances, centered at −58 and −68 ppm, respectively. The ratio of the $T^2$ to $T^3$ peak heights was used to compare levels of cure for different silsesquioxanes. These two broad peaks corresponded to silicon atoms that have formed two and three siloxane bonds, respectively. There are no resonances for silicon atoms that have not condensed at all, or that are bonded to just one other silicone through a siloxane bond. This extent of condensation of the silsesquioxane corresponded to a level of cure that was reasonable for the formation of a three-dimensional network. The observation of $T^2$ resonances in the coating after the final cure indicated that some of the silicon atoms had residual hydroxy or alkoxy groups. The $^{29}Si$ spectra did not change with time, indicating the non-condensed silane groups were stable in the coating.

Useful additives to the electronic transport overcoats of the present invention include, in addition to the already mentioned colloidal silica and acid scavengers, dimethyldimethoxysilane to prepare a silsesquioxane "composite" that is less brittle and more resistant to corona gasses, lubricants such as PDMS or fluorosilicone block copolymers and other trialkoxysilanes, and acrylate polymers with low levels of acrylic acid to improve adhesion of the silsesquioxane to the photoreceptor.

The synthesis of several tertiary arylamine hole transport compounds useful in the practice of the present invention follow:

Synthesis of 9,9-bis{4-[N-ethyl-N-(2-hydroxyethyl)] anilino}fluorene, CTM IA A mixture of 2-(N-ethylanilino)ethanol (198 g), 9-fluorenone (218 g), and 1-propanol (150 mL) was warmed to dissolve the fluorenone, treated with concentrated hydrochloric acid (90 mL), and heated to reflux. After refluxing for two weeks, the cooled reaction mixture was mixed with 1-L each of dichloromethane and water, then treated with more concentrated HCl (40 mL) to lower the pH to ≦1. The dichloromethane layer contained the excess 9-fluorenone, which could be recovered. The acidic water layer was mixed with another liter of dichloromethane, then treated with 50% aqueous sodium hydroxide solution (100 mL) to raise the pH to ≧14. The dichloromethane layer was separated and concentrated under vacuum to a crystallizing oil. The crude material was recrystallized from methanol to give 239 g (81%) of 9,9-bis{4-[N-ethyl-N-(2-hydroxyethyl)] anilino}fluorene as a white crystalline solid, m. p. 171–172° C.

Synthesis of bis{4-[N-ethyl-N-(2-hydroxyethyl)] anilino}diphenylmethane, CTM IIA A mixture of 2-(N-ethylanilino)ethanol (600 g) and acetic anhydride (644 mL) was heated to about 90° C., at which point an exothermic reaction occurred and the temperature increased to about 140° C. After cooling to ambient temperature, the reaction mixture was diluted with 50° C. water, stirred for 5 hr, cooled, and extracted with dichloromethane. The dichloromethane fraction was mixed with more water and neutralized with dilute sodium bicarbonate solution. The dichloroemethane fraction was washed three more times with water, then concentrated under vacuum to 756 g of crude 2-(N-ethylanilino)ethyl acetate, which was used without purification.

Crude 2-(N-ethylanilino)ethyl acetate (346 g), acetic acid (79 mL), toluene (119 mL), and dichlorodiphenylmethane (100 g) were combined and left standing in a stoppered flask for 7 days. The reaction mixture was concentrated under vacuum, taken up in 3 to 4 volumes of ethanol, treated with an excess of sodium hydroxide, refluxed for an hour, acidified to pH 4–5 by addition of concentrated hydrochloric acid, and extracted with DCM. The DCM extract was washed with water, dried with magnesium sulfate, filtered, concentrated, and passed through a short column of silica gel, eluting with DCM. Recrystallization from toluene and from acetone yielded 36 g (34%) of bis{4-[N-ethyl-N-(2-hydroxyethyl)]anilino}diphenylmethane as a white crystalline solid, m.p. 153–154° C.

Synthesis of 1,1-bis{4-[N-ethyl-N-(2-hydroxyethyl)] anilino}-1-phenylethane, CTM IIIA A mixture of 2-(N-ethylanilino)ethanol (82.5 g), acetophenone (60.0 g), 1-propanol (62.5 mL) and concentrated hydrochloric acid (37.5 mL) was refluxed for 64 hr. The cooled reaction mixture was partitioned between dichloromethane and dilute aqueous NaOH solution. The organic phase was washed with water, dried over $MgSO_4$, concentrated under vacuum, and chromatographed on a silica gel column, eluted with dichloromethane, to afford 25.7 g of an oil. Trituration with hexane solidified the product and two recrystallizations from ethyl acetate gave 14.5 g (13%) of 1,1-bis{4-[N-ethyl-N-(2-hydroxyethyl)]anilino}-1-phenylethane as a white crystalline solid, m.p. 99–100° C.

Synthesis of CTM IVP

Hydrogen chloride gas was added to a vigorously stirring mixture of 4-[4-(di-p-tolylamino)phenyl]-2-butanone (182.0 g, 0.5 mol), phenol (141.0 g, 1.50 mol), acetic acid (100 mL), and 3-mercaptopropionic acid (28 mL) until the exotherm induced by the HCl subsided The reaction was stirred for 1 week, washed with hot water, and the product purified by column chromatography and recrystallization from dichloromethane to give a white powder, mass spec m/e 513.

Synthesis of CTM VA

Methyl acrylate (107.5 g, 1.25 mol) was added dropwise to a mixture of aluminum chloride (166.9 g, 1.25 mol) in dichloromethane (200 ml) that had been cooled to 0° C., followed by the addition of 4,4'-dimethyltriphenylamine (273 g, 1 mol) in warm dichloromethane (50 mL). The reaction was stirred overnight at room temperature, heated the next day for 2 hours, and then washed with water. Ethanol and aqueous sodium hydroxide (60 g, 1.5 mol) were added and the reaction was heated to reflux, cooled, and acidified with concentrated hydrochloric acid. The solid was washed several times with water and cyclohexane, followed by recrystallization from cyclohexane to produce a crystalline compound (mp 129.5–131° C.). A solution of this acid substituted intermediate (172.5 g, 0.5 mol) in tetrahydrofuran was added to a tetrahydrofuran solution of lithium aluminum hydride (800 mL, 0.8 mol) in an Erlenmeyer flask, and the contents were heated at reflux, cooled, and diluted with 15% sodium hydroxide to produce a granular precipitate. The solid was dissolved in hexane and passed through a silica column using toluene. The solvent was removed to give a white, crystalline product (88 g).

Synthesis of CTM VIA

The Grignard reagent prepared by the dropwise addition of 4,4'-dimethyl-4"-bromotriphenylamine (264 g, 0.75 mol) in tetrahydrofuran to magnesium turnings (20 g, 0.82 g-atoms) in tetrahydrofuran, was added to solid carbon dioxide in a 5 liter round bottom flask. The carboxylic acid derivative was washed with a solution of water (7 L) and glacial acetic acid (70 mL) to yield 214 g of crude product (90% yield). Recrystallization from toluene gave 169 g (71% overall yield) of pure 4-(di-p-tolylamino)benzoic acid.

4-(Di-p-tolylamino)benzoic acid (69.7 g, 0.22 mol) dissolved in benzene (500 mL), was treated with 1,8-diazabicyclo[5.4.0]undec-7-ene (38 mL, 0.25 mol), followed by the addition of ethyl bromide (33 mL, 0.44 mol). The reaction was filtered to remove salts, washed with saturated ammonium chloride until neutral (1.5 L), washed with water, washed with brine, and dried over magnesium sulfate. The solvent was removed at 40° C. and the residual crystalline solid was washed with cold ethanol to give ethyl 4-(di-p-tolylamino)benzoate (57.4 g, 76% yield).

The double Grignard reagent of 3-chloro-1-propanol was prepared by the addition of methylmagnesium chloride (0.48 mol) in tetrahydrofuran to react with the alcohol, followed by the addition of magnesium turnings (17.4 g, 0.72 g-atoms) to form the Grignard with the chloropropyl moiety. A 200 mL solution of ethyl 4-(di-p-tolylamino)benzoate (65.6 g, 0.190 mol) in tetrahydrofuran was added to a refluxing solution of the double Grignard reagent of 3-chloro-1-propanol, refluxed for an additional 90 min, and quenched with saturated aqueous ammonium chloride. The product was isolated by washing with aqueous ammonium chloride, followed by saturated sodium chloride solution to give a yellow solid. The product was recrystallized from benzene/hexane to give 46.8 g (58.6%) of 4-[4-(di-p-tolylamino)-phenyl]-1,4,7-trihydroxyheptane as an off-white, crystalline solid, m.p. 130.7–132.0° C.

Acetylation of the primary alcohols of 4-[4-(di-p-tolylamino)phenyl]-1,4,7-trihydroxyheptane (2.08 g, 5 mmol) was carried out by heating the triol with acetic anhydride (5 g, 20 mmol) in pyridine (15 mL) at reflux overnight. Water was added to precipitate the product, which was isolated and washed with dilute acid. By NMR and mass spectral analysis it was determined that the tertiary hydroxyl group had been eliminated to form an olefin (mol wt 485.62, 92% yield). The olefin was reduced (2.09 g, 4.3 mmol) with hydrogen using platinum oxide catalyst (0.1 g) in ethanol (25 mL) on a Parr shaker at 40 psi to give the diacetate compound (mol wt of 487.64, 100% yield). The diacetate CTM (1.04 g, 2.13 mol) was hydrolyzed by refluxing overnight in methanol (10 mL) with concentrated hydrochloric acid (1 mL). The product was neutralized with potassium carbonate and water, extracted with ether, and washed several more times to produce CTM VIA as a white crystalline solid, (mol wt 403.04, 87% yield).

Following are described the preparation of sol-gels useful in the practice of the present invention:

Sol-Gel I Preparation of Methylsilsesquioxane and 10 wt % Colloidal Silica with Increasing Levels of CTM IA The synthesis of this silsesquioxane was a modification of those described in U.S. Pat. No. 5,693,442, the disclosure of which is incorporated herein by reference. All chemicals were purchased from Aldrich Chemical Company. Water for the hydrolysis of the alkoxysilanes was purified on a Milli-Q Plus Ultra Pure Water System. A sol-gel formulation was prepared in a two liter round bottom flask as follows. Glacial acetic acid (70.0 grams, 1.17 mol) was added dropwise to methyltrimethoxysilane (306 g, 2.25 mol), followed by the dropwise addition of water (48.0 g, 2.67 mol). The reaction was stirred overnight, diluted by the dropwise addition of isopropanol (523 grams), and 67.0 g of the 30% aqueous dispersion of Ludox LS colloidal silica, previously acidified to pH 4 with glacial acetic acid, was added dropwise. The Ludox LS dispersion addition resulted in additional water (47.0 g, 2.61 mol) for the hydrolysis and condensation of the alkoxysilanes. The reaction mixture was stirred for 3 days before the addition of 4-methyl-2-pentanone (315 ml). After 2 more days of stirring, the solution was filtered through a 1 micron glass filter to give 1202 g of a 15 wt % solution of silsesquioxane. The solid content was determined by drying part of the sample at 60° C. overnight in vacuum. Solutions of 9.1, 16.7, 23.1, and 28.6 wt % CTM IA were prepared by adding increments of CTM I (3.75 g, 7.6 mmol) to four 250 g portions of the silsesquioxane solution. The solutions were stirred for an additional 7 days before coating.

Sol-Gel II Preparation of Methylsilsesquixoane with Increasing Levels of CTM IA The synthesis of Sol-Gel II was the same as Sol-Gel I, except that all of the water (95 g, 5.28 mol) was added during the initial hydrolysis of the silanes, and colloidal silica was not added to the reaction mixture.

Sol-Gel III Preparation of Methylsilsesquioxane, 10 wt % Colloidal Silica, 30 wt % CTM IA and PDMS The synthesis of Sol-Gel III was the same as Sol-Gel I, except the reaction was scaled up by 50%. Glacial acetic acid (105 grams, 1.74 mol) was added dropwise to methyltrimethoxysilane (458 g, 3.37 mol), followed by the dropwise addition of water (72.0 g, 4.0 mol). The reaction was stirred overnight, diluted by the dropwise addition of isopropanol (785 grams), and 100.5 g of the 30% aqueous dispersion of colloidal silica Ludox$^R$ LS, previously acidified to pH 4 with glacial acetic acid, was added dropwise. The Ludox$^R$ LS addition resulted in additional water (70.5 g, 3.92 mol) for the hydrolysis and condensation of the alkoxysilanes. The reaction mixture was stirred for 3 days before the addition of 4-methyl-2-pentanone (473 ml). After 2 more days of stirring, the solution was filtered through a 1 micron glass filter to give a 15 wt % solution of silsesquioxane. The solid content was determined by drying part of the sample at 60° overnight in vacuum. Solutions of 23.1 wt % CTM IA were prepared by adding 11.25 g of CTM IA to three 250 g portions of the silsesquioxane solution. Silanol terminated PDMS of molecular weight 400–700 (PS340 from United Chemical, Piscataway, N.J.) was added to one of these three sol-gels at 0.5 wt %, and to another of the three at 1.0 wt %, based on the expected weight of the silsesquioxane.

Sol-Gel IV Preparation of Methylsilsesquioxane and 10 wt % Colloidal Silica with Increasing Levels of CTM IA The synthesis of sol-gel IV was the same as Sol-Gel I, except 3.75 g, 5.625 g, and 7.5 g of CTM IA were added to sol-gels of 121.5 g, 119.375 g, 117.5 g respectively.

Sol-Gel V. Preparation of Methylpropylsilsesquioxane and 10 wt % Colloidal Silica with Increasing Levels of CTM IA The synthesis of Sol-Gel V was carried out in the same way as for Sol-Gel IV, except the starting trialkoxysilane consisted of equal weights (152.8 g) of methyltrimethoxysilane and propyltrimethoxysilane. Three different levels of charge transport material were prepared by adding 3.75 g, 5.625 g, and 7.5 g of CTM IA to sol-gels of 121.5 g, 119.375 g, 117.5 g respectively.

Sol-Gel VI. Preparation of Propylsilsesquioxane and 10 wt % Colloidal Silica with Increasing Levels of CTM IA The synthesis of Sol-Gel VI was done in the same way as Sol-Gel IV, except the starting trialkoxysilane was propyltrimethoxysilane. Three different levels of charge transport material were prepared by adding 3.75 g, 5.625 g, and 7.5 g of CTM IA to sol-gels of 121.5 g, 119.375 g, and 117.5 g, respectively.

Sol-Gel VII Preparation of Methylsilsesquioxane and 5 wt % Colloidal Silica with 30 wt % of CTM IA The synthesis of Sol-Gel VII was similar to that of Sol-Gel I. Glacial acetic acid (70.0 grams, 1.17 mol) was added dropwise to a solution of methyltrimethoxysilane (306 g, 2.25 mol) and 2 g of DMS-E12 Epoxypropoxypropyl Terminated Polydimethylsiloxane molecular weight 900–1100 (Gelest, Tullytown, Pa.), followed by the dropwise addition of ethyl acetate (100 g) and then water (70 g, 3.89 mol), and the reaction stirred overnight. Ludox$^R$ LS (33.3 g of the 30% aqueous dispersion of colloidal silica, previously acidified to pH 4 with glacial acetic acid) was added dropwise. The Ludox$^R$ LS addition resulted in additional water (23.3 g, 1.29 mol) for the hydrolysis and condensation of the alkoxysilanes. The reaction was stirred for 4 days and then ethanol (523 grams) was added dropwise. The reaction was stirred for 3 days, CTM IA (60 g, 0.122 mol) added, stirring continued for another day before the addition of 4-methyl-2-pentanone (315 ml).

Sol-Gel VIII Preparation of Methylsilsequioxane with Increasing Levels of CTM IIA and CTM IIIA This sol-gel was prepared in the same way as Sol-Gel I, except that two different CTM diols were used. Four samples of 0.15 g increments of CTM IIA and CTM IIIA replaced a corresponding amount of a 10 g sol-gel solution, to keep the total weight of the solution at 10 g. The solutions were hand coated on a 27° C. constant temperature coating block using a 2 mil coating blade on a film having a 2.5 micron CTL.

Sol-Gel IX Preparation of Methylsilsesquioxane and 10 wt % Colloidal Silica with Increasing Levels of CTM IVP The synthesis of Sol-Gel IX was carried out by the same procedure as that used for Sol-Gel I, except that CTM IVP was added in place of CTM IA at 9.1, 16.7, 23.1, and 28.6 wt %.

Sol-Gel X Preparation of Methylsilsesquioxane and 10 wt % Colloidal Silica with Increasing Levels of CTM IVP The synthesis of Sol-Gel X was carried out by the same procedure as that used for Sol-Gel I, except that CTM IVP was added in place of CTM IA at 9.1, 16.7, 23. 1, and 28.6 wt % and the solution was allowed to stir for 48 hours.

Sol-Gel XI Preparation of Methylsilsesquioxane and 10 wt % Colloidal Silica with Increasing Levels of CTM VA The synthesis of Sol-Gel XI was carried out by the same procedure as that used for Sol-Gel I, except that CTM VA was added in place of CTM IA and the solution was allowed to stir for 48 hours.

Sol-Gel XII Preparation of Methylsilsesquioxane and 10 wt % Colloidal Silica with Increasing Levels of CTM VIA The synthesis of Sol-Gel XII was carried out by the same procedure as that used for Sol-Gel I, except that CTM VIA was added in place of CTM IA and the solution was allowed to stir for 48 hours.

Coating of Sol-Gels I–VI and VIII–XII onto Photoreceptor Films

Two negative charging, near infrared sensitive films were used as substrates for the sol-gel overcoats. These electrophotographic substrates were prepared in the following manner. Poly(ethylene terephthalate) (7 mils), that had a vacuum coated conducting layer of nickel (400 Angstroms), was solvent coated with a 0.5 micron thick charge generation layer(CGL) consisting of a 37.5/12.5/50 oxotitanium phthalocyanine/oxotitaniumtetrafluorophthalocyanine/polyester ionomer mixture and then with a 2.0 micron thick charge transport layer (CTL) consisting of a 20/20/60 tri-p-tolylamine/1,1-bis-(N,N-di-p-tolylaminophenyl) cyclohexane/(5/1 MAKROLON$^R$ polycarbonate and polyester) mixture to form a "thin film". "Thick films" were generated in a similar manner, and consisted of a 23 micron thick CTL and a barrier layer between the nickel and CGL made of AMILAN$^R$ polyamide, obtained from Toray Chemical, Japan. Thin films were generally charged to −50 or −100 V surface potential during testing, thick films were charged to −500 to −700 V surface potential during testing.

The sol-gel solution was then coated over the photoreceptors at a web speed of 3 m/min and using a drying profile of 104.5, 104.5, 82, 71, and 27° C. from the first to fifth dryers respectively to produce a 2 micron layer. Portions of some coatings were cured at 82° C. for an additional 24 hours.

Alternatively, Sol-Gel X was coated over the photoreceptor by hand using a 2 mil coating knife on a 40° C. coating block and dried in an oven at 60° C. to produce a 4 micron layer.

Sol-Gels XI and XII were coated over the photoreceptor by hand using a 2 mil coating knife on a 40° C. coating block and dried in an oven at 82° C. to produce a 4 micron layer.

Coating of Sol-Gels VII onto Photoreceptor Drums

A Hewlett-Packard 5si photoreceptor drum was overcoated by dipping it into a tank containing Sol-Gel VII. The coating was dried in an oven at 90° C. for 1 h, and later cured by ramping the temperature to 120° C. in an oven overnight.

Analysis

The cure of the sol-gel overcoat was determined by Solid State $^{29}$Si NMR spectra obtained on a Chemagnetics CMX-300 Solid State NMR Spectrometer operating at 59.5607 MHz, on samples scraped off the coatings with a razor blade. Spectroscopic examination of the solid product with silicon-29 NMR shows that the number of $T^2$ silicon atoms is not less than half the number of $T^3$ silicon atoms in any of these materials. This is evident because the ratio of $T^2/T^3$ peaks is >0.5 in all the spectra of the coatings. Thus there are a significant number of available binding sites left in the silsesquioxane to account for the Si—O—C bond in these materials. It is not possible to differentiate whether the chemical shift of a $T^2$ silicon atom is due to attachment of an alkoxy group or a hydroxy group. However, the incorporation of the hydroxy substituted tertiary amine into the silsesquioxane network would be consistent with these spectra.

The bulk conductivity of the overcoats was evaluated by measuring the residual potential after photodischarge of the corona charged photoreceptor using three different techniques. (1) Low intensity continuous exposure (LICE) was used to evaluate photoreceptor film samples for their dark decay and photosensitivity characteristics. Characterization employs a corona to charge a photoreceptor sample to an initial surface potential (−50 or −100 V for thin films; −500 or −700 for thick films) that is then exposed to 1 erg/cm$^2$sec of light for 13 sec at the wavelength of interest through a "transparent" electrostatic probe. The surface potential is continuously recorded before and during the exposure. Measurements at different relative humidities (RH) were carried out after the films were equilibrated for approximately 1 hr. (2) Flash exposure is used to determine the response of a photoreceptor to light exposures of short duration. The photoreceptor sample is corona charged to an initial surface potential and then exposed to a 160 $\mu$sec xenon flash. Wavelength selection is accomplished using narrow band (10 nm width at 50% of the maximum transmission intensity) dichroic filters. The exposure occurs through a "transparent" electrostatic probe and the surface potential is continuously recorded before, during and after exposure. The data reported was obtained 1 sec after the flash exposure. (3) The initial and final surface potentials of the overcoated films were compared after cycling in a Regeneration Sensitometer. Regeneration sensitometry is an electrical-only test carried out on a belt drive apparatus fitted with a DC gridded corona charger, voltmeters, erase lamp, and a 160 $\mu$sec xenon flash lamp for exposing the film. For each test, six different overcoated films were assembled into a continuous belt and evaluated for 1000 cycles, each revolution of the belt taking approximately 5 sec to complete. Humidity effects on photodischarge between the different silsesquioxanes were compared by running the samples at 50% and 15% (RH) and monitoring the initial (pre-exposure) and final (post exposure) "toe" voltage (Vtoe) (after the erase exposure) of each frame of photoreceptor.

The surface conductivities of the overcoats were compared using a lateral image spread technique described in the previous silsequioxane film overcoat patents. The overcoated photoreceptor was corona charged and then exposed through a 2.5 mm slit to produce a "square well" surface potential pattern. The latent image shape is recorded by moving the photoreceptor past a high-resolution surface voltmeter probe. The image shape is measured as a function of time, where greater changes in image shape indicate higher overcoat conductivity.

EXAMPLE 1

Sol-gel I, a methylsilsesquioxane composition prepared with 10 wt % colloidal silica and increasing levels of CTM IA was coated on a 2 micron-thick organic charge transport layer (OCTL) disposed on a polymeric film substrate with a 0.5 micron charge generation layer (CGL). The samples were charged to −100 volts, and measurements by the procedures described above gave the following results:

| Sample | CTM IA Charge (Wt %) | -Vtoe (LICE) | -Vtoe (flash) (52% RH) | -Vtoe (flash) (34% RH) | -Vtoe (flash) (15% RH) | $T^2/T^3$ NMR |
|---|---|---|---|---|---|---|
| 1a | 0 | 50 | 57 | 53 | — | 0.58 |
| 1b | 9.1 | 18 | 32 | 40 | 74 | |
| 1c | 16.7 | 1 | 11 | 17 | 29 | 0.59 |
| 1d | 23.1 | 6 | 13 | 11 | 21 | |
| 1e | 28.6 | 3 | 9 | 8 | 13 | 0.62 |
| no overcoat | | | 8 | | | |

As indicated by these measurements, the higher the concentration of CTM IA in the overcoat, the greater the voltage discharge resulting from hole transport. The LICE experiment showed that the films became very conductive when exposed to the continuous light. The flash experiment was conducted with the sample at different humidity in order to mitigate the effect of proton transport from residual water. The residual voltage was only −13 V even at the low humidity which would be consistent with charge dissipation by hole transport. The NMR curing ratios of T2/T3 indicate similar levels of siloxane condensation in all three samples. In fact increasing values of T2/T3 would be expected as the concentration of alcohol functionalities from the CTM IA become more available with increasing concentration.

The samples were subjected to 1000 charge-expose-erase cycles on the Regeneration Sensitometer, followed by measurement of initial and residual voltages, with the following results:

| | CTM IA | 31% RH | | 20% RH | |
|---|---|---|---|---|---|
| Sample | (Wt %) | $-V_0$ Init/Final | -Vtoe Init/Final | $-V_0$ Init/Final | -Vtoe Init/Final |
| 1a | 0 | 180/180 | 130/130 | 210/200 | 155/155 |
| 1b | 9.1 | 175/165 | 100/100 | 190/180 | 110/110 |
| 1c | 16.7 | 130/130 | 25/25 | 145/120 | 30/25 |

-continued

| Sample | CTM IA (Wt %) | 31% RH -$V_0$ Init/Final | 31% RH -Vtoe Init/Final | 20% RH -$V_0$ Init/Final | 20% RH -Vtoe Init/Final |
|---|---|---|---|---|---|
| 1d | 23.1 | 130/130 | 25/25 | 140/120 | 25/25 |
| 1e | 28.6 | 120/120 | 20/20 | 130/110 | 25/25 |
| no overcoat | | 90/80 | 5/5 | 100/90 | 5/5 |

The above experiment shows that increasing the amount of CTM IA in the silsesquioxane overcoat increases the charge transport properties of the overcoat. The initial surface potential was stable or slightly decreased between the beginning of the experiment at the first cycle ($-V_0$ initial) and the end of the experiment at 1000 cycles ($-V_0$ final). Exposure of the film to an erase lamp results in a discharge of the film over the course of the 1000 cycles (Vtoe initial/final). The Vtoe voltage approaches zero as the amount of CTM IA is increased indicating improved charge migration with increasing concentration of CTM. The values are similar for the first and 1000 cycles indicating that the charge is moving through in the photoreceptor. Additionally, the same photodischarge characteristics are observed at low humidity where ionic conduction is less likely to occur. These results all indicate that an increasing amount of hole transport is occurring at higher concentrations of CTM.

EXAMPLE 2

The samples in Example 1 were cured for an additional 24 hours at 82° C., then charged to −100 V. Subsequent measurements gave the following results:

| Sample | CTM IA (Wt %) | −Vtoe (LICE) | −Vtoe (flash) (36% RH) | $T^2/T^3$(NMR) |
|---|---|---|---|---|
| 2a | 0 | 45 | — | 0.53 |
| 2b | 9.1 | 60 | 47 | |
| 2c | 16.7 | 10 | 23 | 0.56 |
| 2d | 23.1 | 7 | 15 | |
| 2e | 28.6 | 17 | 17 | 0.57 |

As with the results obtained in Example 1, the higher the concentration of CTM in the overcoat, the greater the voltage discharge resulting from hole transport. Both the LICE and the flash measurements indicate a lower residual voltage as the concentration of CTM is increased. The NMR curing ratios of T2/T3 indicate similar levels of siloxane condensation in all three samples.

EXAMPLE 3

Sol-gel I, used in Example 1, was coated at 2 microns thickness directly onto a charge generation layer, with no interposed organic charge transport layer (OCTL). Measurements on these samples, after charging to −100 V, gave the following results:

| Sample | CTM IA (Wt %) | −Vtoe (LICE) | −Vtoe (flash) (34% RH) | $T^2/T^3$(NMR) |
|---|---|---|---|---|
| 3a | 0 | 58 | 81 | 0.57 |
| 3b | 9.1 | 40 | 64 | |
| 3c | 16.7 | 2 | 28 | |

-continued

| Sample | CTM IA (Wt %) | −Vtoe (LICE) | −Vtoe (flash) (34% RH) | $T^2/T^3$(NMR) |
|---|---|---|---|---|
| 3d | 23.1 | 5 | 21 | |
| 3e | 28.6 | 12 | 18 | |

As with the results obtained in Example 1, the higher the concentration of CTM in the overcoat, the greater the voltage discharge resulting from hole transport. Both the LICE and the flash measurements indicate a lower residual voltage as the concentration of CTM is increased.

EXAMPLE 4

The samples in Example 3 were cured for an additional 24 hours at 82° C., then charged to −100 V. Samples 4d and 4e could not be charged to −100 V due to poor charge acceptance. Subsequent measurements gave the following results:

| Sample | CTM IA (Wt %) | −Vtoe (LICE) | −Vtoe (flash) (36% RH) | $T^2/T^3$(NMR) |
|---|---|---|---|---|
| 4a | 0 | 88 | 89 | 0.53 |
| 4b | 9.1 | 62 | 77 | |
| 4c | 16.7 | 8 | 42 | |
| 4d | 23.1 | * | 26 | |
| 4e | 28.6 | * | * | |

As with the results obtained in Example 1, the higher the concentration of CTM in the overcoat, the greater the voltage discharge resulting from hole transport. Both the LICE and the flash measurements show a lower residual voltage as the concentration of CTM is increased.

EXAMPLE 5

Sol-gel II, a methylsilsesquioxane composition prepared with increasing levels of CTM IA in the absence of Ludox$^R$ LS colloidal silica was coated on a 2 micron-thick organic charge transport layer (OCTL) disposed on a polymeric photoreceptor substrate. Measurements on the resulting samples, following charging to −100 V, gave the following results:

| Sample | CTM IA (Wt %) | −Vtoe (LICE) | −Vtoe (flash) (34% RH) | $T^2/T^3$(NMR) |
|---|---|---|---|---|
| 5a | 0 | 40 | 53 | |
| 5b | 9.1 | 38 | 41 | |
| 5c | 16.7 | 37 | 48 | 0.77 |
| 5d | 23.1 | 37 | 44 | |
| 5e | 28.6 | 19 | 33 | |

As with the results obtained in Example 1, the higher the concentration of CTM in the overcoat, the greater the voltage discharge resulting from hole transport. Both the LICE and the flash measurements exhibit a lower residual voltage as the concentration of CTM is increased.

EXAMPLE 6

The samples in Example 5 were cured for an additional 24 hours at 82° C., then charged to −100 V. Subsequent measurements gave the following results:

| Sample | CTM IA (Wt %) | −Vtoe (LICE) | −Vtoe (flash) (36% RH) | $T^2/T^3$(NMR) |
|---|---|---|---|---|
| 6a | 0 | 58 | 43 | |
| 6b | 9.1 | 62 | 52 | |
| 6c | 16.7 | 65 | 46 | .66 |
| 6d | 23.1 | 41 | 39 | |
| 6e | 28.6 | 29 | 31 | |

The above data show that Sol-Gel I, which contains colloidal silica, decreases in residual voltage with increasing CTM IA concentration more systematically than Sol-Gel II, which does not have colloidal silica. This is probably due to a higher level of cure in the silsesquioxane with the colloidal silica. Generally the residual voltage was lower as the CTM I increased, indicating increased charge transport through the silsesquioxane layer.

EXAMPLE 7

Sol-gel II, used in Example 5, was coated at 2 microns thickness directly onto a charge generation layer, with no interposed organic charge transport layer (OCTL). Measurements on these samples, after charging to −100 V, gave the following results:

| Sample | CTM IA (Wt %) | −Vtoe (LICE) | −Vtoe (flash) (34% RH) |
|---|---|---|---|
| 7a | 0 | 61 | 78 |
| 7b | 9.1 | 69 | 76 |
| 7c | 16.7 | 60 | 76 |
| 7d | 23.1 | 60 | 74 |
| 7e | 28.6 | 0 | 14 |

As with the results obtained in Example 1, the higher the concentration of CTM in the overcoat, the greater the voltage discharge resulting from hole transport. Both the LICE and the flash measurements show a lower residual voltage as the concentration of CTM is increased.

EXAMPLE 8

The samples in Example 7 were cured for an additional 24 hours at 82° C., then charged to −100 V. Subsequent measurements gave the following results:

| Sample | CTM IA (Wt %) | −Vtoe (LICE) | −Vtoe (flash) (36% RH) |
|---|---|---|---|
| 8a | 0 | 68 | 79 |
| 8b | 9.1 | 89 | 91 |

-continued

| Sample | CTM IA (Wt %) | −Vtoe (LICE) | −Vtoe (flash) (36% RH) |
|---|---|---|---|
| 8c | 16.7 | 85 | 89 |
| 8d | 23.1 | 89 | 88 |
| 8e | 28.6 | 36 | 49 |

The above data show that Sol-Gel I, which contains colloidal silica, decreases in residual voltage with increasing CTM IA concentration more systematically than Sol-Gel II, which does not have colloidal silica. This is probably due to a higher level of cure in the silsesquioxane with the colloidal silica. Generally the residual voltage was lower as the CTM IA increased, indicating increased charge transport through the silsesquioxane layer.

EXAMPLE 9

A 2 micron thick layer of Sol-Gel III, a methylsilsesquioxane composition containing 10 wt % colloidal silica, 23 wt % CTM IA, and PDMS was coated on the same photoreceptor substrate having a 2 micron-thick CTL layer CTL as used in Example 1. The concentration of PDMS was 0, 0.5, or 1.0 wt % as shown in the following table. After charging of flash samples to −200 V, measurements on the photoreceptors gave the following results:

| Sample | CTM IA (Wt %) | PDMS (Wt %) | −Vtoe (flash) (36% RH) |
|---|---|---|---|
| 9a | 0 | 0 | 131 |
| 9b | 23.1 | 0 | 26 |
| 9c | 23.1 | 0.5 | 19 |
| 9d | 23.1 | 1.0 | 23 |

As with the results obtained in Example 1, the higher the concentration of CTM in the overcoat, the greater the voltage discharge resulting from hole transport. Both the LICE and the flash measurements indicate a lower residual voltage as the concentration of CTM is increased. The PDMS did not interfere with the transport properties of the photoreceptors.

The samples were subjected to 1000 charge-expose-erase cycles, followed by measurement of initial and residual voltages, with the following results:

| Example | CTM IA (Wt %) | 34% RH -$V_0$ Init/Final | 34% RH -Vtoe Init/Final | 20% RH -$V_0$ Init/Final | 20% RH -Vtoe Init/Final |
|---|---|---|---|---|---|
| 9a | 0 | 250/250 | 160/160 | 210/210 | 155/155 |
| 1a | 0 | 250/250 | 170/170 | 200/200 | 160/160 |
| 9b | 23.1 | 160/150 | 15/15 | 135/120 | 10/10 |
| 9c | 23.1 | 130/130 | 25/25 | 140/120 | 10/10 |
| 1d | 23.1 | 170/150 | 20/25 | 130/115 | 20/20 |
| no overcoat | | 100/100 | 5/5 | 100/80 | 5/5 |

The data in Example 9 show that PDMS in small quantities does not interfere with the transport in the sol-gel layer. The films maintained constant charge acceptance, as seen by the stable or small decrease in voltage between the beginning of the experiment at the first cycle ($-V_0$ initial) and the end of the experiment at 1000 cycles ($-V_0$ final). The Vtoe voltage approaches zero as the amount of CTM IA is increased indicating improved charge migration with increasing concentration of CTM. The values are similar for the first and 1000 cycles indicating that the charge is moving through the photoreceptor. Additionally, the same photodischarge characteristics are observed at low humidity (20%RH) where ionic conduction is less likely to occur.

EXAMPLE 10

A 2 micron thick layer of Sol-Gel IV, a methylsilsesquioxane composition containing 10 wt % colloidal silica, and 0–30 wt % CTM IA was coated on the same film having a 2 micron-thick CTL as used in Example 1 ("thin" photoreceptor), and on a film having a 23 micron-thick CTL and a 1 micron-thick AMILAN$^R$ polyamide barrier layer underneath the CGL ("thick" photoreceptor). Thin samples were charged to −100 V except for those marked (*), which were charged to −50 V. Thick samples were charged to −500 V.

Measurements on these coatings gave the following results:

| Sample | CTM IA (Wt %) | −Vtoe (flash) (51% RH) on thin film | −Vtoe (flash) (11% RH) on thin film | −Vtoe (flash) (46% RH) on thick film |
|---|---|---|---|---|
| 10a | 0 | 32 | 100 | 50 |
| 10b | 17.1 | 15 | 47 | 33 |
| 10c | 23.9 | 10 | 51 | 27 |
| 10d | 29.9 | 12 | 47 | 26 |
| 10e | No overcoat | 4 | 36 | 24 |
| 10f | No overcoat | 3* | 30* | |

These results show that incorporation of the CTM IA reduces the residual voltage in a standard thickness photoreceptor. As with the results obtained in Example 1, the higher the concentration of CTM in the overcoat, the greater the voltage discharge resulting from hole transport. The flash measurements indicate a lower residual voltage as the concentration of CTM is increased.

The samples on the 2 micron-thick CTL film were subjected to 1000 charge-expose-erase cycles, followed by measurement of initial and residual voltages, with the following results:

| Sample | CTM IA (Wt %) | 45% RH -$V_0$ Init/Final | 45% RH -Vtoe Init/Final | 20% RH -$V_0$ Init/Final | 20% RH -Vtoe Init/Final |
|---|---|---|---|---|---|
| 10a | 0 | 115/115 | 75/75 | 130/130 | 100/100 |
| 10b | 17.1 | 75/75 | 15/18 | 75/75 | 15/20 |
| 10c | 23.9 | 70/70 | 25/30 | 65/70 | 25/30 |
| 10d | 29.9 | 75/75 | 15/20 | 70/70 | 15/20 |
| 10e | No overcoat | 50/50 | 5/5 | 50/50 | 5/5 |
| 11d* | 29.9 | 90/85 | 40/40 | 90/90 | 40/45 |

*Sample 11d contains a methyl-propylsilsesquioxane composition, as described in Example 11.

The films maintained constant charge acceptance, as seen by the stable or small decrease in voltage between the beginning of the experiment at the first cycle ($-V_0$ initial) and the end of the experiment at 1000 cycles ($-V_0$ final). The Vtoe voltage approaches 0 as the amount of CTM IA is increased indicating improved charge migration with increasing concentration of CTM. The values are similar for the first and 1000 cycles indicating that the charge is moving through and not building up in the photoreceptor. Additionally, the same photodischarge characteristics are observed at low humidity (20%RH) where ionic conduction is less likely to occur.

EXAMPLE 11

A 2 micron thick layer of Sol-Gel V, a methylpropylsilsesquioxane composition containing 10 wt % colloidal silica and 0–30 wt % CTM IA was coated on the same film having a 2 micron-thick CTL as used in Example 1 ("thin" photoreceptor), and on a film having a 23 micron-thick CTL and a 1 micron-thick AMILAN$^R$ polyamide barrier layer underneath the CGL ("thick" photoreceptor). Thin samples were charged to −100 V except for those marked (*), which were charged to −50 V. Thick samples were charged to −500 V.

Measurements on these coatings gave the following results:

| Sample | CTM IA (Wt %) | −Vtoe (flash) (51% RH) on thin film | −Vtoe (flash) (11% RH) on thin film | −Vtoe (flash) (46% RH) on thick film |
|---|---|---|---|---|
| 11a | 0 | 42 | 102 | 58 |
| 11b | 17.1 | 33 | 73 | 41 |
| 11c | 23.9 | 19 | 65 | 29 |
| 11d | 29.9 | 18 | 51 | 30 |
| 11e | No overcoat | 4 | 36 | 24 |
| 11f | No overcoat | 3* | 30* | |

As with the results obtained in Example 1, the higher the concentration of CTM in the overcoat, the greater the voltage discharge resulting from hole transport. The flash measurements indicate a lower residual voltage as the concentration of CTM is increased.

The samples on the 2 micron-thick CTL photoreceptor were subjected to 1000 charge-expose-erase cycles, followed by measurement of initial and residual voltages, with the following results:

| Sample | CTM IA (Wt %) | 45% RH -$V_0$ Init/Final | 45% RH -Vtoe Init/Final | 20% RH -$V_0$ Init/Final | 20% RH -Vtoe Init/Final |
|---|---|---|---|---|---|
| 11a | 0 | 100/90 | 85/80 | 100/85 | 90/80 |
| 11b | 17.1 | 35/40 | 15/18 | 75/75 | 30/30 |
| 11c | 23.9 | 25/30 | 15/20 | 20/20 | 10/15 |
| 11d | 29.9 | 25/30 | 20/25 | 25/30 | 25/30 |
| 11e | No overcoat | 55/55 | 5/5 | 45/30 | 10/10 |

The films maintained constant charge acceptance as seen by the stable or small decrease in voltage between the beginning of the experiment at the first cycle ($-V_0$ initial) and the end of the experiment at 1000 cycles ($-V_0$ final). The Vtoe voltage approaches 0 as the amount of CTM IA is increased indicating improved charge migration with increasing concentration of CTM. The values are similar for the first and 1000 cycles indicating that the charge is not building up in the film. Additionally, the same photodischarge characteristics are observed at low humidity (20%RH) where ionic conduction is less likely to occur.

The samples on the 23 micron-thick CTL photoreceptor were subjected to 1000 charge-expose-erase cycles, followed by measurement of initial and residual voltages, with the following results:

Initial and Residual Voltages after 1000 charge-expose-erase cycles on 23 micron CTL film

| Sample | CTM IA (Wt %) | 50% RH -$V_0$ Init/Final | 50% RH -Vtoe Init/Final | 20% RH -$V_0$ Init/Final | 20% RH -Vtoe Init/Final |
|---|---|---|---|---|---|
| 11a | 0 | 660/630 | 100/90 | 690/670 | 140/180 |
| 11b | 17.1 | 670/620 | 25/30 | 690/660 | 40/80 |
| 11c | 23.9 | 620/610 | 20/25 | 680/640 | 25/70 |
| 11d | 29.9 | 620/600 | 25/30 | 670/630 | 30/80 |
| 11e | No overcoat | 630/610 | 10/20 | 680/670 | 20/60 |

Comparison of Examples 10 and 11 indicate the coatings containing methylsilsesquioxane had slightly better photodischarge than those containing methyl-propylsilsesquioxane at similar loadings of CTM I. The methylsilsesquioxane coatings also had better regeneration properties than the methyl-propylsilsesquioxane coatings.

Measurement of Lateral Image Spread Before and After 2 Minutes of Negative Corona Exposure Samples 10a, 10c, 11a, 11c and the control film 10e with 2 micron CTL were charged to 100 V, and a 2.5 mm square well latent image was made by exposure to light. The image did not increase with time over 10 minutes on any of the films. The films were then exposed to negative corona gases for 2 min. The image did not spread after the corona exposure on either the control film with no overcoat, or the films that had the sol-gel overcoats. These results indicate that, unlike solid electrolyte sol-gel overcoats that carry charge by ionic conduction (i.e. via lithium iodide), the sol-gel overcoats reported here do not suffer from lateral image spread on exposure to corona gas.

EXAMPLE 12

A 2 micron thick layer of Sol-Gel VI, a propylsilsesquioxane composition containing 10 wt % colloidal silica and 0–30 wt % CTM IA was coated on the same film having a 2 micron-thick CTL as used in Example I ("thin" photoreceptor), and on a film having a 23 micron-thick CTL and a 1 micron-thick AMILAN$^R$ polyamide barrier layer underneath the CGL ("thick" photoreceptor). Thin samples were charged to −100 V except for those marked (*), which were charged to −50 V. Thick samples were charged to −500 V,

| Sample | CTM IA (Wt %) | −Vtoe (flash) (51% RH) on thin film | −Vtoe (flash) (46% RH) on thick film |
|---|---|---|---|
| 12a | 0 | 57 | 65 |
| 12b | 17.1 | 38 | 53 |

-continued

| Sample | CTM IA (Wt %) | −Vtoe (flash) (51% RH) on thin film | −Vtoe (flash) (46% RH) on thick film |
|---|---|---|---|
| 12c | 23.9 | 29 | 40 |
| 12d | 29.9 | 32 | 47 |
| 12e | No overcoat | 4 | 24 |
| 12f | No overcoat | 3* | |

Comparison of Example 12 with Examples 10 and 11 indicates the propylsilsesquioxane does not have as good photodischarge as the methyl or methyl-propylsilsesquioxane overcoat at similar loadings of CTM IA. This is probably due to poorer compatibility of the organic photoconductor with the propylsilsequioxane matrix, as evidenced by a slight haze that was observed in these films.

EXAMPLE 13

Sol-gel VII was coated over a Hewlett-Packard 5si drum using a drum coater. Drying at 90° C. and curing at 120° C. produced a sample with a silsesquioxane overcoat thickness estimated to be 1 micron. The surface potential was measured before and after curing using a QEA PDT2000 (Burlington, Mass.). The photoreceptor drums were charged to −600 V. No change in the residual voltage resulting from curing of the overcoat was observed. Furthermore, the applied overcoat caused no change in the sensitometry of the photoreceptor. This is shown in the chart below. An exposure of 1.81 $\mu J/cm^2$ discharged the drum to −27 V residual potential, essentially the same value as obtained for the drum before the sol-gel was placed on it. The drum was then cured at 120° C. and the test performed again. A slightly less intense exposure of 1.63 $\mu J/cm^2$ discharged the drum to −36 V, a slightly higher residual potential. Confirmation that the sensitivity was unchanged in the two experiments is seen by comparing the energy needed to discharge the drum from −600 to −200 V. Essentially the same values were measured for the overcoated drum before and after curing, 0.56 and 0.57 $\mu J/cm^2$, respectively.

Sensitometry Characteristics for Photoreceptor Drums

| | Maximum Exposure | Maximum Exposure | Energy for 600 V to 200 V Discharge |
|---|---|---|---|
| Before Cure | 1.81 $\mu J/cm^2$ | 27 Volts | 0.56 $\mu J/cm^2$ |
| After Cure | 1.63 $\mu J/cm^2$ | 36 Volts | 0.57 $\mu J/cm^2$ |

The silsesquioxane overcoated photoreceptor drum was placed in a Hewlett-Packard 5si Printer. A total of one thousand prints were obtained under controlled environments of high, ambient, and low humidity. All of the prints showed excellent image quality.

EXAMPLE 14

Sol-Gel VIII, a methylsilsequioxane composition containing increasing levels of CTM IIA and CTM IIIA, was prepared in the same way as Sol-Gel I, except that two different CTM compounds were used. The solutions were hand coated on a 27° C. constant temperature coating block using a 2 mil coating blade on a film having a 2.5 micron CTL.

| Sample | CTM ILA (Wt %) | CTM IIIA (Wt %) | Thickness (microns) | −Vtoe (flash) |
|---|---|---|---|---|
| 14a | 0 | 0 | 3.75 | 71 |
| 14b | 9.2 | | 3.5 | 98 |
| 14c | 17.1 | | 3.5 | 84 |
| 14d | 23.9 | | 4.5 | 66 |
| 14e | 29.9 | | 4.5 | 61 |
| 14f | | 9.2 | 3.5 | 77 |
| 14g | | 17.1 | 3.25 | 57 |
| 14h | | 23.9 | 4.0 | 68 |
| 14i | | 29.9 | 4.5 | 41 |

Following charging to −100 V, the flash Vtoe was measured for each sample. The results in the foregoing table show that the mixture of CTM IIA and CTM IIIA does not carry charge as well as CTM IA used in previous examples. Nonetheless, the photodischarge was more efficient as the amount of CTM increased in the overcoat.

EXAMPLE 15

A 2 micron-thick coating of Sol-Gel IX , a methylsilsesquioxane composition containing 10 wt % colloidal silica with increasing levels of CTM IVP was coated on the same film having a 2 micron-thick CTL as used in Example 1. Following charging of the samples to −200 V, the following measurements were obtained:

| Sample | CTM IVP (Wt %) | −Vtoe (flash) (36% RH) |
|---|---|---|
| 15a | 0 | 131 |
| 15b | 9.1 | 96 |
| 15c | 16.7 | 134 |
| 15d | 23.1 | 125 |
| 15e | 28.6 | 125 |

The data above show that CTM IVP at the higher concentrations resulted in only a slight lowering of the residual voltage upon photodischarge of the underlying photoreceptor. This is probably a consequence of hydrolytic instability of the Si—O-aryl linkage at higher drying temperatures. Films incorporating CTM IVP into the silsesquioxane network that were dried at ambient temperature remained clear. However because they were dried at higher temperatures, they developed surface deposits which were assumed to be CTM IVP. The experiment was repeated below in Example 16, but the films were dried and cured at 60° C.

EXAMPLE 16

A 4 micron thick coating of Sol-Gel X, a methylsilsesquioxane composition containing 10 wt % colloidal silica with increasing levels of CTM IVP, was coated on the same film that had a 2 micron CTL as used in Example 1. Following charging of the samples to −100 V, the following measurements were obtained:

| Example | CTM IVP (Wt %) | −Vtoe (LICE) | −Vtoe (flash) (42% RH) |
|---|---|---|---|
| 16a | 0 | 72 | 72 |
| 16b | 9.1 | 68 | 64 |
| 16c | 16.7 | 60 | 65 |

-continued

| Example | CTM IVP (Wt %) | −Vtoe (LICE) | −Vtoe (flash) (42% RH) |
|---|---|---|---|
| 16d | 23.1 | 50 | 69 |
| 16e | 28.6 | 0 | 35 |

The data above show that CTM IVP lowered the residual voltage upon photodischarge of the underlying photoreceptor.

EXAMPLE 17

A 4 micron thick coating of Sol-Gel XI, a methylsilsesquioxane composition containing 10 wt % colloidal silica with increasing levels of CTM VA, was coated on the same film that had a 2 micron CTL as used in Example 1. Following charging of the samples to −100 V, the following measurements were obtained:

| Example | CTM VA (Wt %) | −Vtoe (LICE) | −Vtoe (flash) (44% RH) |
|---|---|---|---|
| 17a | 0 | 75 | 94 |
| 17b | 9.1 | 70 | 85 |
| 17c | 16.7 | 50 | 63 |
| 17d | 23.1 | 40 | 63 |
| 17e | 28.6 | 25 | 65 |

The data above show that CTM VA lowered the residual voltage upon photodischarge of the underlying photoreceptor.

EXAMPLE 18

A 4 micron thick coating of Sol-Gel XII, a methylsilsesquioxane composition containing 10 wt % colloidal silica with increasing levels of CTM VIA, was coated on the same film that had a 2 micron CTL as used in Example 1. Following charging of the samples to −100 V, the following measurements were obtained:

| Example | CTM VIA (Wt %) | −Vtoe (LICE) | −Vtoe (flash) (44% RH) |
|---|---|---|---|
| 18a | 0 | 75 | 94 |
| 18b | 9.1 | 70 | 65 |
| 18c | 16.7 | 55 | 59 |
| 18d | 23.1 | 65 | 66 |
| 18e | 28.6 | 15 | 61 |

The data above show that CTM VIA lowered the residual voltage upon photodischarge of the underlying photoreceptor.

The invention has been described in detail with particular reference to certain preferred embodiments thereof, but it is to be understood that variations and modifications can be effected within the spirit and scope of the invention.

What is claimed is:

1. An electrophotographic element comprising:

an electrically conducting layer;

a charge generating layer overlying said electrically conducting layer; and a first charge transport layer overlying said electrically conducting layer, said charge transport layer being an insulator and comprising the reaction product in an aqueous medium of a mixture comprising polydimethylsiloxane (PDMS), a silsesquioxane polymer, and a hole transport compound that comprises a tertiary arylamine moiety containing at least one alcoholic or one phenolic hydroxy substituent.

2. The electrophotographic element of claim 1 wherein said first charge transport layer is an abrasion-resistant overcoat overlying said charge generating layer.

3. The electrophotographic element of claim 1 wherein said silsesquioxane polymer is the product of the hydrolysis and condensation of at least one alkyltrialkoxysilane having the structure $$R^1—Si—(OR)_3$$

wherein R is an alkyl group containing 1 to about 4 carbon atoms, and $R^1$ is an aliphatic, cycloaliphatic, or aromatic group containing 1 to about 12 carbon atoms.

4. The electrophotographic element of claim 3 wherein $R^1$ is selected from the group consisting of alkyl containing 1 to about 12 carbon atoms, fluoroalkyl containing 1 to about 12 carbon atoms, cycloalkyl containing 5 to about 12 carbon atoms, and aryl containing 6 to about 12 carbon atoms.

5. The electrophotographic element of claim 4 wherein $R^1$ is an alkyl group containing 1 to about 3 carbon atoms.

6. The electrophotographic element of claim 5 wherein $R^1$ is a methyl group.

7. The electrophotographic element of claim 3 wherein said mixture includes about 9 to about 30 weight percent of said hole transport agent based on said alkyltrialkoxysilane.

8. The electrophotographic element of claim 7 wherein said mixture includes about 15 to about 25 weight percent of said hole transport agent based on said alkyltrialkoxysilane.

9. The electrophotographic element of claim 3 wherein said mixture further comprises colloidal silica.

10. The electrophotographic element of claim 9 wherein said mixture contains up to about 20 weight percent colloidal silica based on said alkyltrialkoxysilane.

11. The electrophotographic element of claim 10 wherein said mixture contains about 5 to about 10 weight percent colloidal silica based on said alkyltrialkoxysilane.

12. The electrophotographic element of claim 2 further comprising a second charge transport layer disposed between said charge generating layer and said abrasion-resistant overcoat.

13. The electrophotographic element of claim 12 wherein said charge transport layer comprises a triarylamine.

14. The electrophotographic element of claim 2 wherein said abrasion-resistant overcoat has a thickness of about 0.5 micron to about 10 microns.

15. The electrophotographic element of claim 14 wherein said abrasion-resistant overcoat has a thickness of about 1 micron to about 3 microns.

16. The electrophotographic element of claim 1 wherein said aqueous medium further comprises a water-miscible organic solvent.

17. The electrophotographic element of claim 16 wherein said water-miscible solvent is selected from the group consisting of methanol, ethanol, isopropyl alcohol, methyl isobutyl ketone, and mixtures thereof.

18. The electrophotographic element of claim 1 wherein said hole transport compound is selected from the group consisting of CTM IA
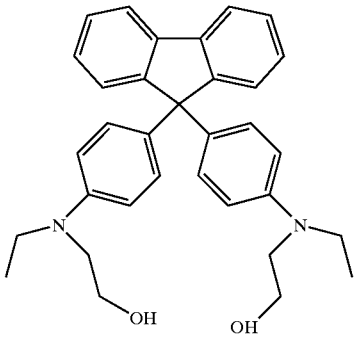
CTM IIA
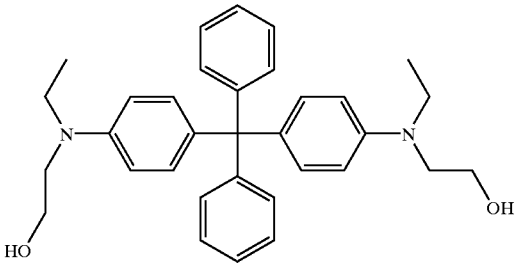
CTM IIIA
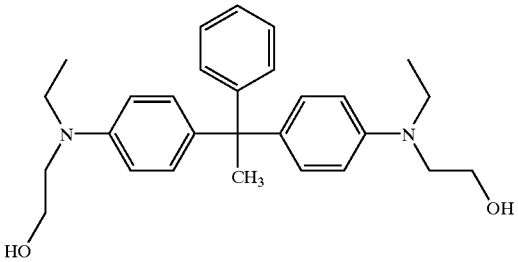
CTM IVP
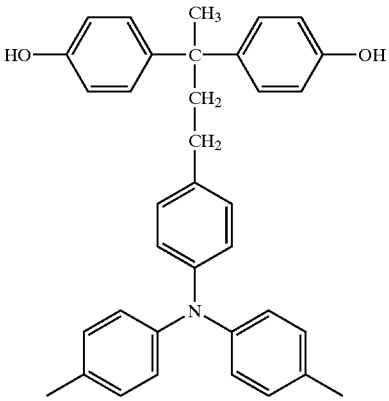
-continued
CTM VA
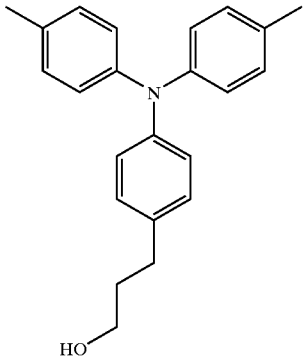
CTM VIA
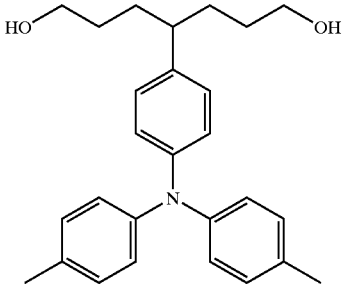
CTM VIIA
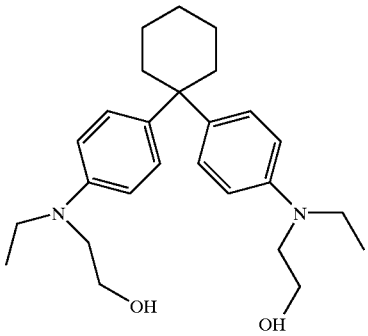
CTM VIIIA
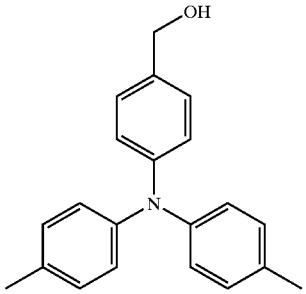
CTM IXA
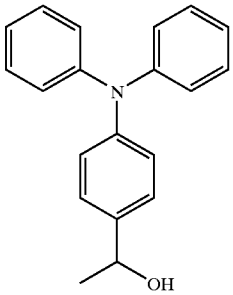

-continued
CTM XA
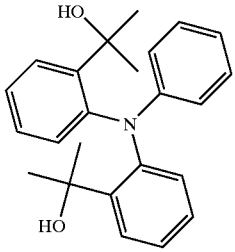
CTM XIA
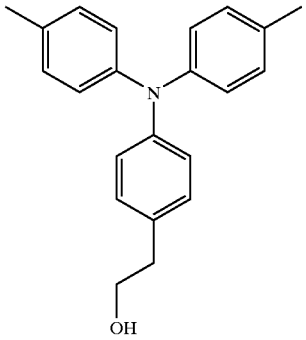
CTM XIIA
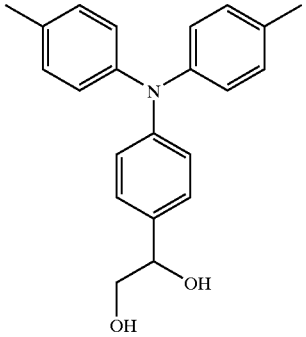
CTM XIIIA
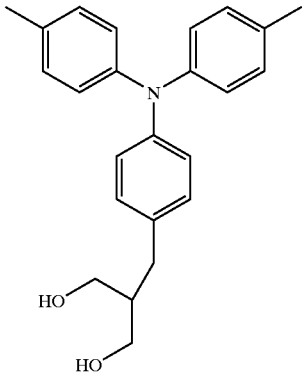
-continued
CTM XIVA
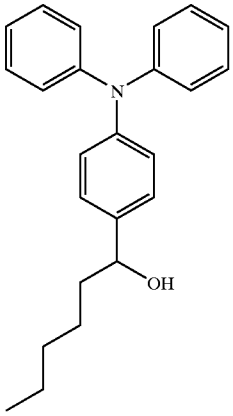
CTM XVA
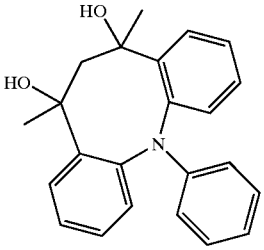
CTM XVIA
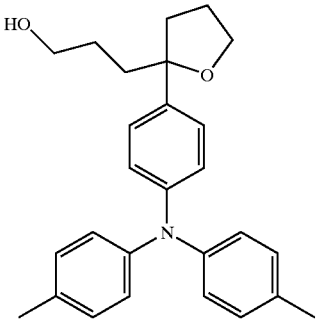
CTM XVIIA
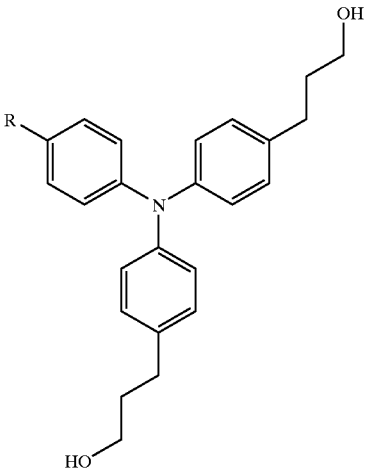
R = —H or —$CH_3$ -continued
CTM XVIIIA
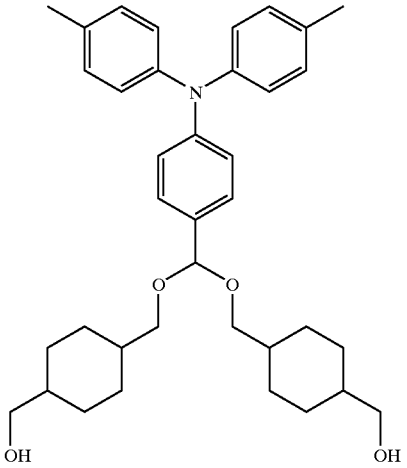
CTM XIXA
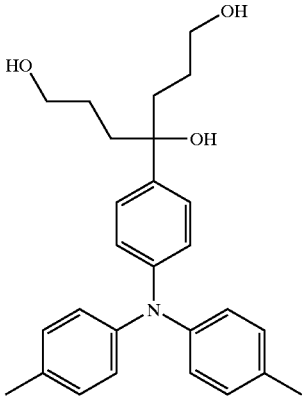
CTM XXA
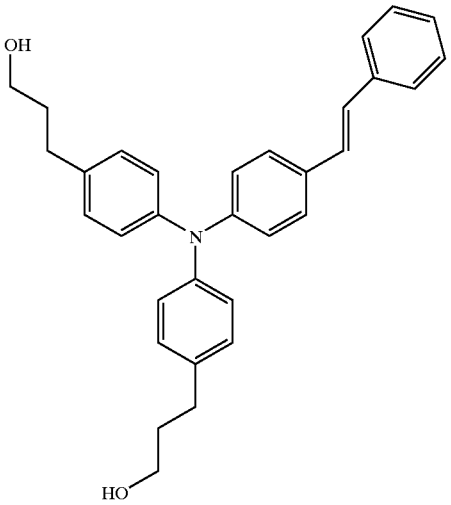
-continued
CTM XXIA
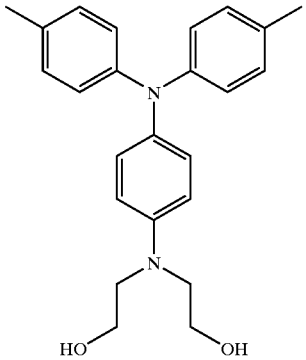
CTM XXIIA
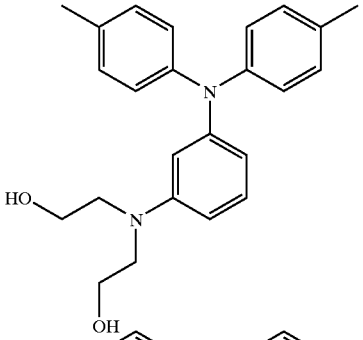
CTM XXIIIA
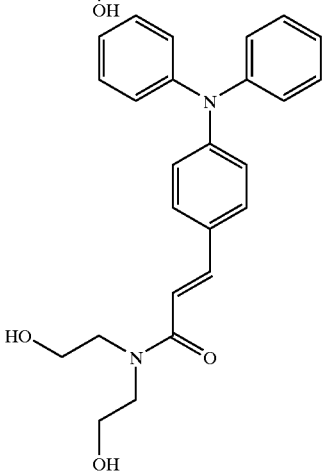
CTM XXIVA
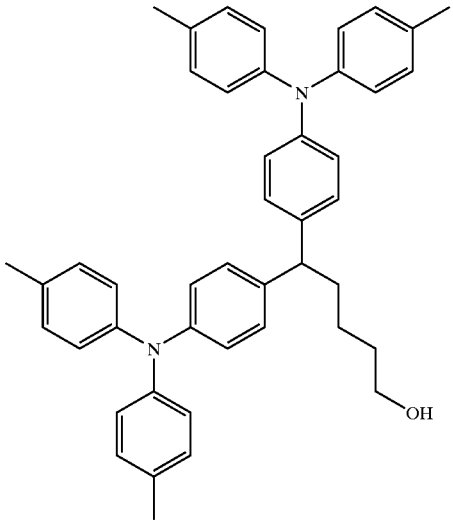

-continued
CTM XXVA
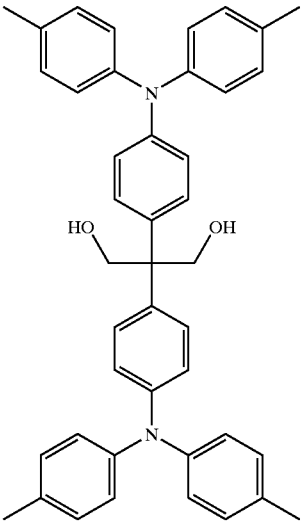
CTM XXVIA
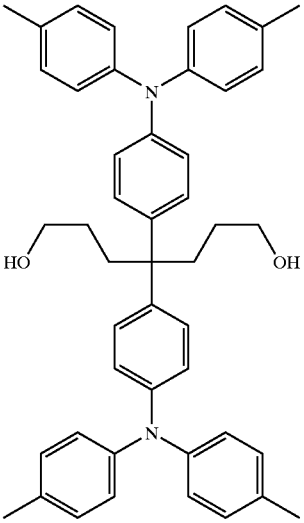
CTM XXVIIA
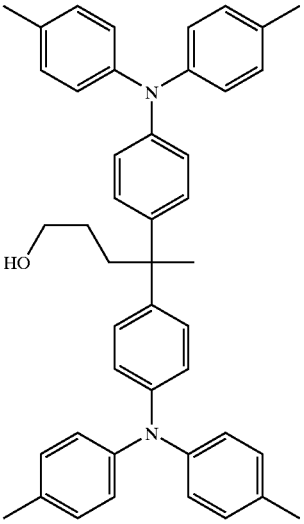
-continued
CTM XXVIIIA
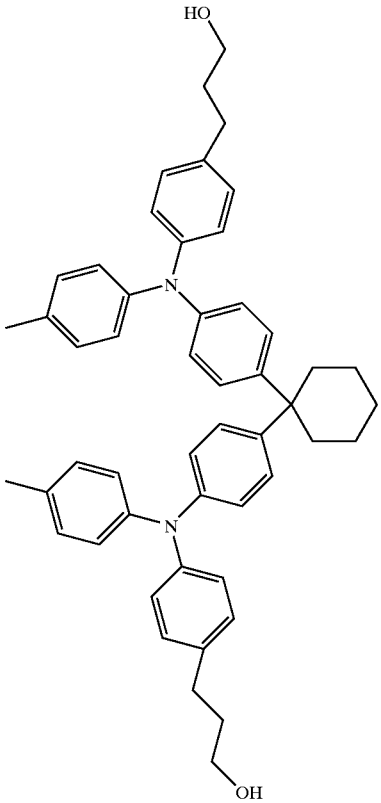
CTM XXIXA
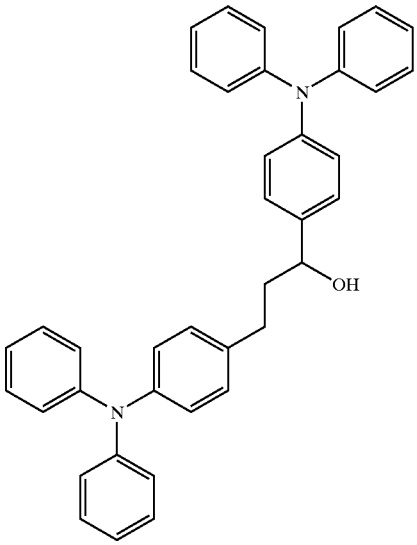

-continued
CTM XXXA
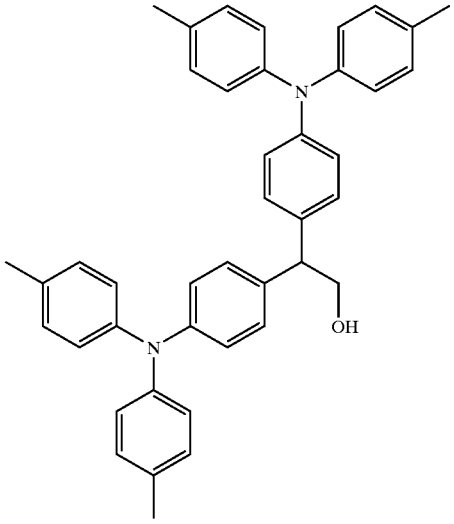
CTM XXXIA
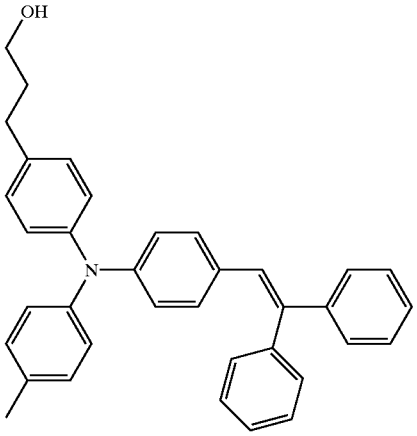
CTM XXXIIP
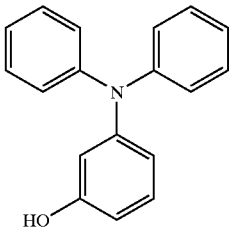
CTM XXXIIIP
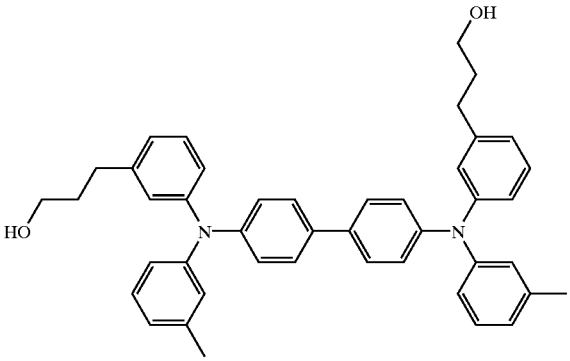
-continued
CTM XXXIVP
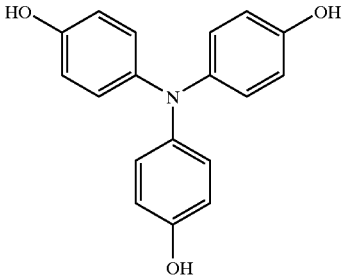
CTM XXXVP
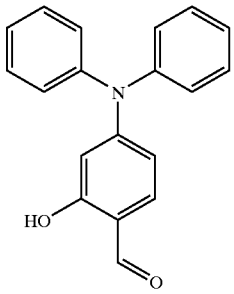
CTM XXXVIP
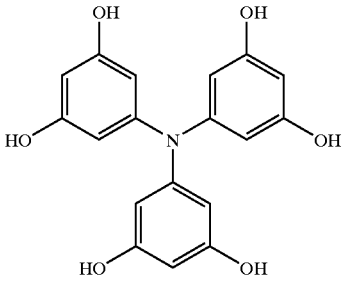
CTM XXXVIIP
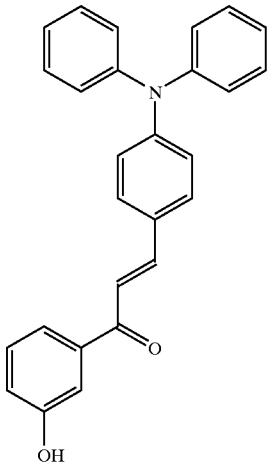

-continued

CTM XXXVIIIP

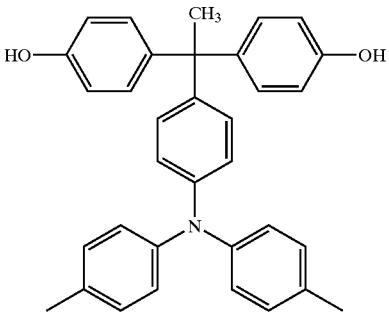

CTM XXXIXP

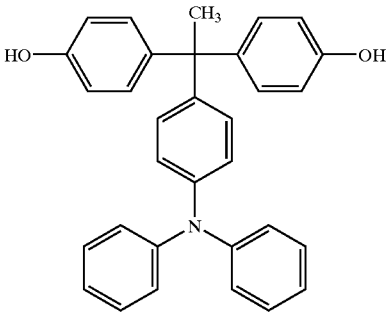

CTM XLP

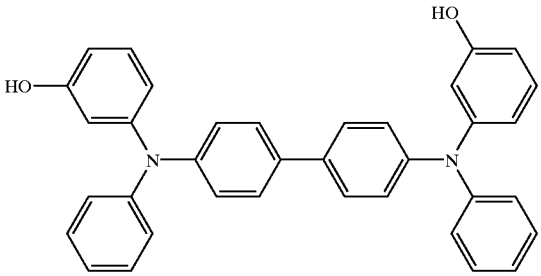

CTM XLIP

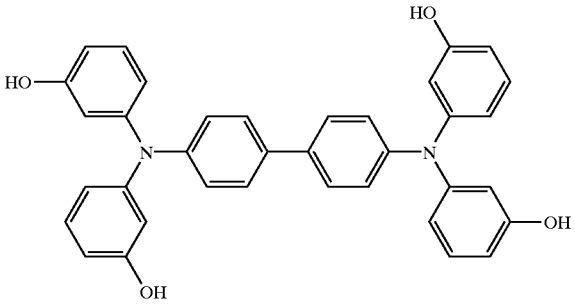

CTM XLIIP

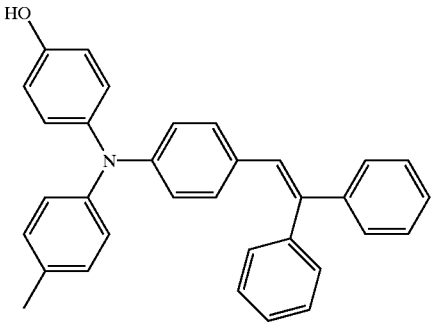

-continued

CTM XLIIIP

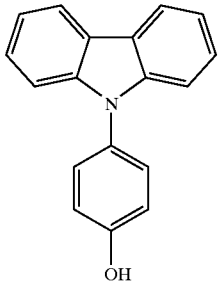

and mixtures thereof.

19. The electrophotographic element of claim 1 wherein said hole transport compound has the structure $$(A)_x—(LINK—OH)_y$$

wherein A is a tertiary arylamine moiety containing up to about 40 carbon atoms, LINK is an aliphatic or cycloaliphatic moiety containing 1 to about 10 carbon atoms, x is 1 or 2, and y is 1 to 6.

20. The electrophotographic element of claim 19 wherein A is a triarylamine moiety.

21. The electrophotographic element of claim 19 wherein A is an N-alkylanilino moiety, LINK is an alkylene moiety containing 1 to about 4 carbon atoms, and y is 1 or 2.

22. The electrophotographic element of claim 19 wherein A is an N,N-dialkylanilino moiety, LINK is ethylene, x is 2, and y is 2.

23. The electrophotographic element of claim 1 wherein said hole transport compound has the structure $$A—(OH)_y$$

wherein A is an arylene moiety containing up to about 40 carbon atoms and comprising at least one tertiary arylamine moiety, and y is 1 to 6.

24. The electrophotographic element of claim 23 wherein A comprises a triarylamine moiety.

25. The electrophotographic element of claim 24 wherein said hole transport compound has the structure

CTM IVP

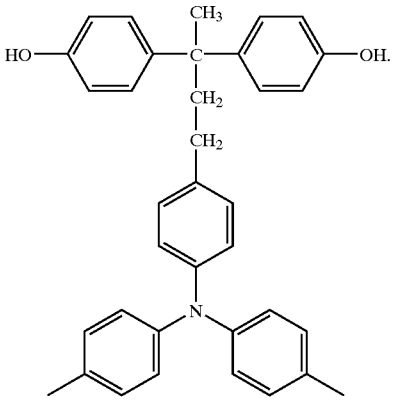

26. The electrophotographic element of claim 1 further comprising a barrier layer overlying said electrically conducting layer.

27. An electrophotographic element comprising:

an electrically conducting layer;

a charge generating layer overlying said electrically conducting layer; and a first charge transport layer overlying said electrically conducting layer, said charge transport layer being an insulator and comprising the reaction product in an aqueous medium of a mixture comprising a silsesquioxane polymer and a hole transport compound that comprises a tertiary arylamine moiety containing at least one alcoholic or one phenolic hydroxy substituent, wherein said hole transport compound is selected from the group consisting of

CTM IA

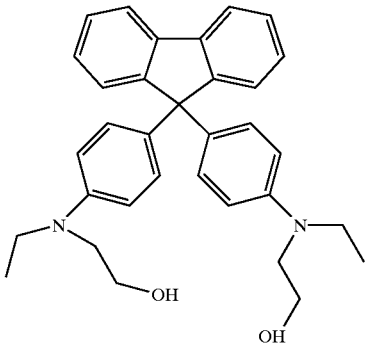

,

CTM IIA

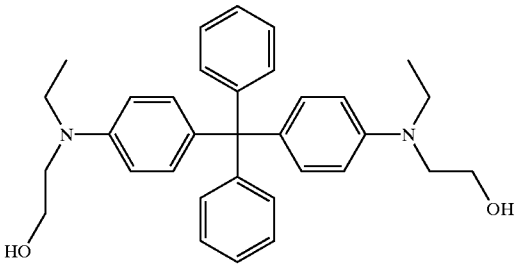

,

-continued

CTM IIIA

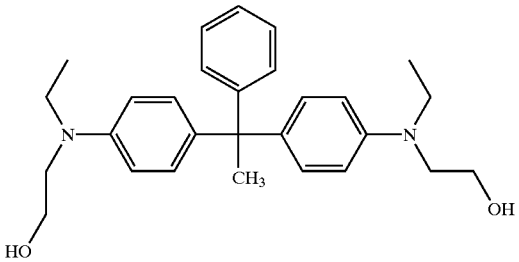

,

CTM VA

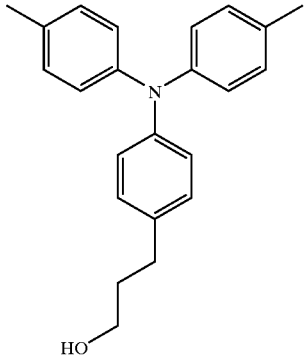

,

CTM VIA

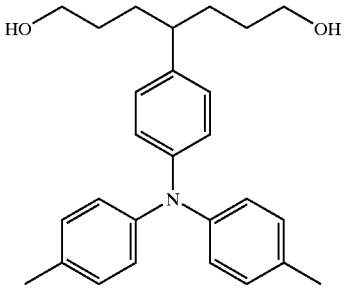

, and mixtures thereof.

* * * * *